US008464813B2

(12) United States Patent
Osborne, Jr.

(10) Patent No.: US 8,464,813 B2
(45) Date of Patent: Jun. 18, 2013

(54) CUTTER ASSEMBLY FOR A RAISE BORING REAMER

(75) Inventor: Andrew J. Osborne, Jr., Dallas, TX (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 17 days.

(21) Appl. No.: 12/694,609

(22) Filed: Jan. 27, 2010

(65) Prior Publication Data

US 2010/0126778 A1 May 27, 2010

Related U.S. Application Data

(63) Continuation-in-part of application No. 11/425,366, filed on Jun. 20, 2006, now abandoned.

(51) Int. Cl.
*E21B 10/26* (2006.01)
*E21B 10/10* (2006.01)

(52) U.S. Cl.
USPC ..... 175/361; 175/344; 175/406

(58) Field of Classification Search
USPC ..... 175/344, 347, 351, 355, 361, 373, 175/385, 406
See application file for complete search history.

(56) References Cited

U.S. PATENT DOCUMENTS 3,220,494 A 11/1965 Cannon et al.
3,550,972 A 12/1970 Coski
3,847,235 A 11/1974 Goodfellow
4,042,047 A 8/1977 Dively et al.
4,053,244 A 10/1977 Dively
4,071,098 A 1/1978 Dively et al.
4,096,917 A 6/1978 Harris
4,136,748 A 1/1979 Dickerhoff
4,142,598 A 3/1979 Maxsted
4,167,980 A * 9/1979 Saxman ..... 175/374
4,179,000 A 12/1979 Mitchell et al.
4,191,267 A 3/1980 Snaddon
4,194,578 A 3/1980 Mitchell
4,228,863 A 10/1980 Liljekvist et al.
4,270,618 A 6/1981 Owens
4,301,876 A 11/1981 Harrison et al.
4,386,670 A 6/1983 Westermark
4,427,307 A 1/1984 Norlander et al.
4,456,082 A 6/1984 Harrison
4,688,651 A 8/1987 Dysart
4,697,652 A 10/1987 Walk
4,741,471 A 5/1988 Sullivan
4,832,135 A 5/1989 Walk et al.
5,056,610 A 10/1991 Oliver et al.
5,199,510 A 4/1993 Stanley et al.
5,341,890 A 8/1994 Cawthorne et al.
5,358,061 A 10/1994 Van Nguyen (Continued)

FOREIGN PATENT DOCUMENTS

WO 03078787 A1 9/2003

*Primary Examiner* — Brad Harcourt
(74) *Attorney, Agent, or Firm* — Schmeiser, Olsen & Watts LLP

(57) ABSTRACT

A raise boring reamer assembly includes a saddle, and a journal assembly carried by the saddle. The journal assembly includes nose and gage shanks, and a cutter is carried by the journal assembly. Nose and gage wiper rings are positioned proximate to the nose and gage shanks, respectively. The nose and gage wiper rings move debris in opposed directions in response to the rotation of the cutter.

12 Claims, 30 Drawing Sheets

U.S. PATENT DOCUMENTS 5,429,200 A 7/1995 Blackman et al.
5,740,871 A * 4/1998 Williams ..... 175/371
5,842,700 A 12/1998 Fang et al.
6,336,512 B1 1/2002 Siracki et al.
6,533,051 B1 3/2003 Singh et al.
2004/0134687 A1 7/2004 Radford et al.
2005/0178588 A1 8/2005 Lin
2005/0252693 A1 11/2005 Brannstrom
2006/0191721 A1 * 8/2006 Brolund ..... 175/373
2007/0289780 A1 12/2007 Osborne

* cited by examiner

CUTTER ASSEMBLY FOR A RAISE BORING REAMER

CROSS-REFERENCE TO RELATED APPLICATIONS

This application claims priority to U.S. patent application Ser. No. 11/425,366 filed on Jun. 20, 2006, the contents of which are incorporated by reference as though fully set forth herein.

BACKGROUND OF THE INVENTION

1. Field of the Invention

This invention relates generally to earth boring tools.

2. Description of the Related Art

Earth boring tools are commonly used to bore through a formation to form a borehole. Such boreholes may be formed for many different reasons, such as drilling for oil, minerals and water. One type of earth boring tool is a rotary earth bit. Several examples of rotary earth bits are disclosed in U.S. Pat. Nos. 3,550,972, 3,847,235, 4,096,917, 4,136,748, 4,427,307 and 4,688,651 4,741,471 and 5,358,061. A rotary earth bit generally includes one or more lugs coupled together to form an earth bit body, wherein the lugs include a lug journal positioned towards a lower portion of the corresponding lug. The rotary earth bit includes a cutting cone rotatably mounted to a corresponding lug journal to form a bit bearing cavity therebetween. The cutting cone is rotatably mounted to the lug journal using ball and roller bearings. One or more bit seal assemblies are positioned to hold lubricant in the bit bearing cavity to facilitate the rotation of the cutting cone about the lug journal.

In operation, the rotary earth bit is operatively coupled to a drill string, and moved downwardly through the formation and rotated to form the borehole. As the rotary earth bit moves downwardly and rotates, the cutting cone engages the formation and rotates about the lug journal in response. Debris flows towards the bit bearing cavity in response to the rotary earth bit being moved downwardly through the formation. Debris in the bit bearing cavity restricts the ability of the cutting cone to rotate about the lug journal. The debris can be of many different types, such as cuttings, water and/or mud.

Another type of earth boring tool is a raise boring reamer assembly. Several examples of raise boring reamer assemblies are disclosed in U.S. Pat. Nos. 3,220,494, 4,042,047, 4,053,244, 4,071,098, 4,142,598, 4,179,000, 4,191,267, 4,194,578, 4,228,863, 4,270,618, 4,301,876, 4,386,670, 4,456,082, 4,697,652, 4,832,135, 5,199,510, as well as U.S. Patent Application No. 20050252693 and International Application No. PCT/SE2003/000433.

A raise boring reamer assembly includes a raise boring body which carries one or more cutter assemblies. The cutter assemblies are positioned towards an upper portion of the raise boring body. In a typical set-up, the cutter assembly includes a saddle carried by the raise boring body, and a cutter rotatably mounted to a journal assembly to form a cutter bearing cavity therebetween. The journal assembly is mounted to the saddle in a repeatably removeable manner, and the cutter is rotatably mounted to the journal assembly using ball and roller bearings. One or more seal assemblies are positioned to hold lubricant in the cutter bearing cavity to facilitate the rotation of the cutter about the journal assembly.

In operation, the raise boring reamer assembly is operatively coupled to a drill string, and moved upwardly through the formation and rotated to form the borehole. As the raise boring reamer assembly moves upwardly and rotates, the cutter engages the formation and rotates about the journal assembly in response. Debris flows towards the cutter bearing cavity in response to the raise boring reamer assembly being moved upwardly through the formation. Debris in the cutter bearing cavity undesirably restricts the ability of the cutter to rotate about the journal assembly. Hence, it is desirable to restrict the ability of debris to flow to the cutter bearing cavity, and to move debris away.

BRIEF SUMMARY OF THE INVENTION

The present invention is directed to a raise boring reamer assembly. The novel features of the invention are set forth with particularity in the appended claims. The invention will be best understood from the following description when read in conjunction with the accompanying drawings.

DETAILED DESCRIPTION OF THE INVENTION

Figure 1A:
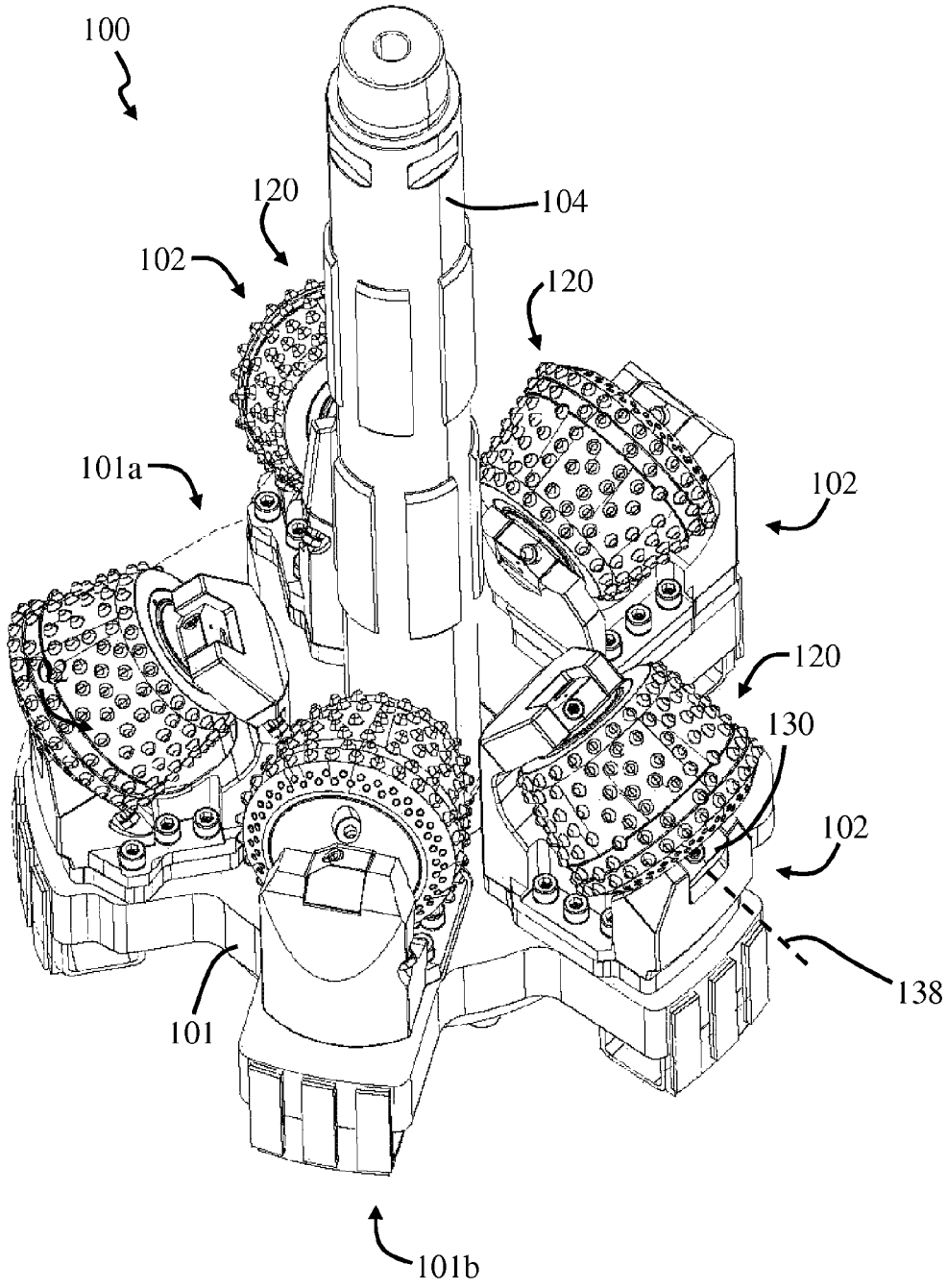
FIGS. 1*a* and 1*b* are perspective and top views, respectively, of a raise boring reamer assembly.
Figure 1B:
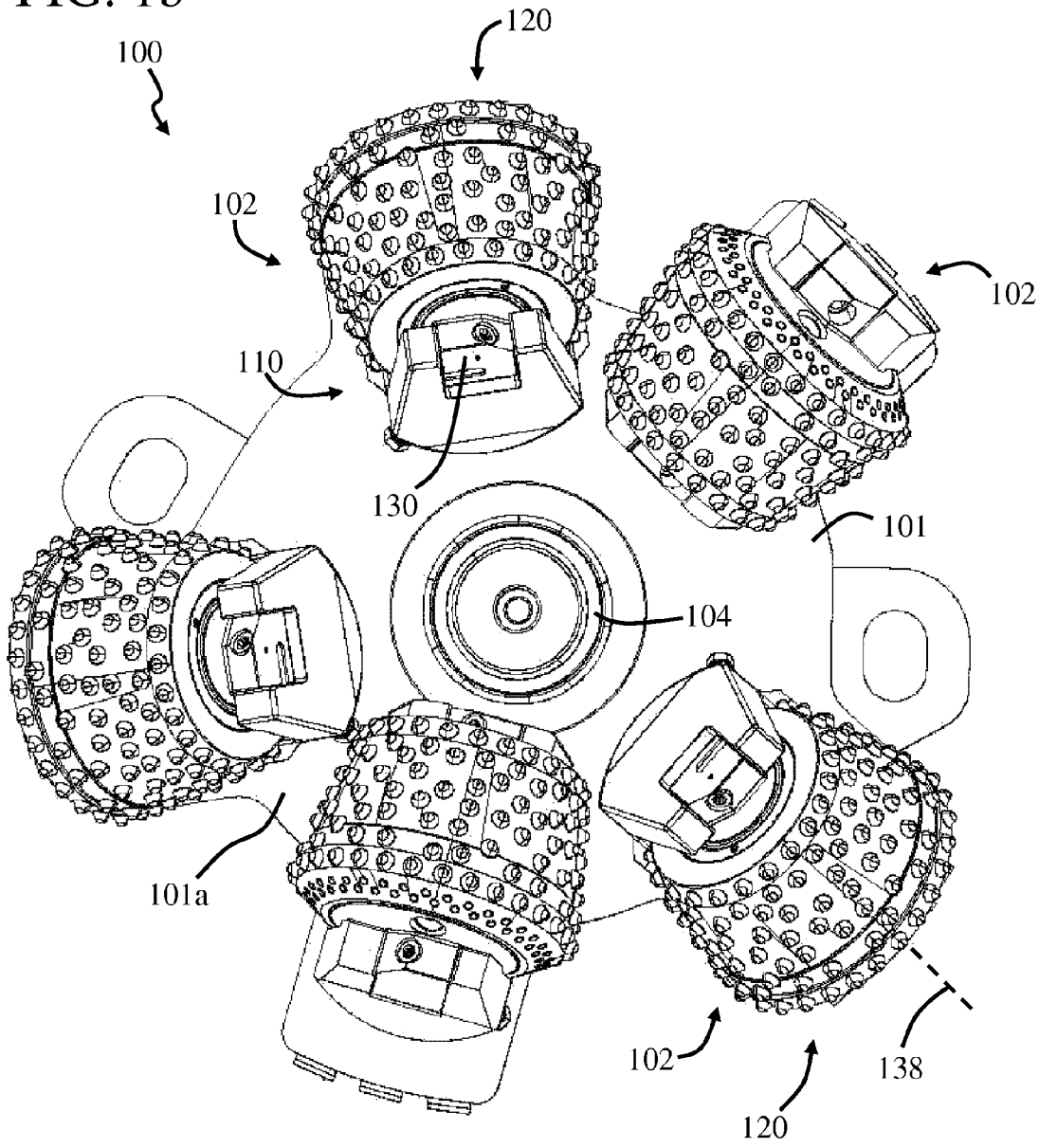

FIGS. 1*a* and 1*b* are perspective and top views, respectively, of a raise boring reamer assembly 100. In this embodiment, raise boring reamer assembly 100 includes a raise boring body 101 which carries five cutter assemblies 102. The cutter assemblies are positioned proximate to an upper portion 101*a* of raise boring body 101, and away from a lower portion 101*b* of raise boring body. It should be noted that raise boring reamer assembly 100 generally includes one or more cutter assemblies carried by raise boring body 101. In this embodiment, five cutter assemblies 102 are shown for illustrative purposes.

The cutter assemblies carried by raise boring body 101 are coupled thereto in a repeatably removeable manner. The cutter assemblies can be coupled to raise boring body 101 in a repeatably removeable manner in many different ways, such as by using a fastener. There are many different types of fasteners which can be used to couple the cutter assemblies to raise boring body 101. In some embodiments, the fasteners include nuts and bolts.

In this embodiment, cutter assembly 102 includes a saddle 110 carried by raise boring body 101, and a cutter 120 rotatably mounted to a journal assembly 130 to form a cutter bearing cavity therebetween. Journal assembly 130 is mounted to saddle 110 in a repeatably removeable manner, and cutter 120 is rotatably mounted to journal assembly 130 using ball and roller bearings. One or more seal assemblies are positioned to hold lubricant in the cutter bearing cavity to facilitate the rotation of cutter 120 about journal assembly 130. It should be noted that the cutter bearing cavity, ball and roller bearings and seal assemblies are not shown in FIGS. 1*a* and 1*b*, but they are shown in FIGS. 9*b* and 9*c*, and will be discussed in more detail therewith.

In operation, raise boring reamer assembly 100 is operatively coupled to a drill string 104, and moved upwardly through the formation and rotated to form the borehole. It should be noted that raise boring reamer assembly 100 is operatively coupled to drill string 104 proximate to upper portion 101*a* of raise boring body 101, and away from lower portion 101*b*. In this way, raise boring reamer assembly 100 is operatively coupled to drill string 104 so that the cutter assemblies are positioned proximate to drill string 104, and away from lower portion 101*b*.

As raise boring reamer assembly 100 moves upwardly and rotates, cutter 120 engages the formation and rotates about journal assembly 130 in response. Debris flows towards the cutter bearing cavity in response to raise boring reamer assembly 100 being moved upwardly through the formation. Debris in the cutter bearing cavity restricts the ability of cutter 120 to rotate about journal assembly 130. Hence, it is desirable to restrict the ability of debris to flow to the cutter bearing cavity, and to move debris away. As will be discussed in more detail below, raise boring reamer assembly 100 includes one or more wipers (not shown) which restrict the ability of the debris to flow to the seal assemblies, and to move debris away. In this way, debris is less likely to undesirably flow into the cutter bearing cavity, and more likely to move away.

Figure 2A:
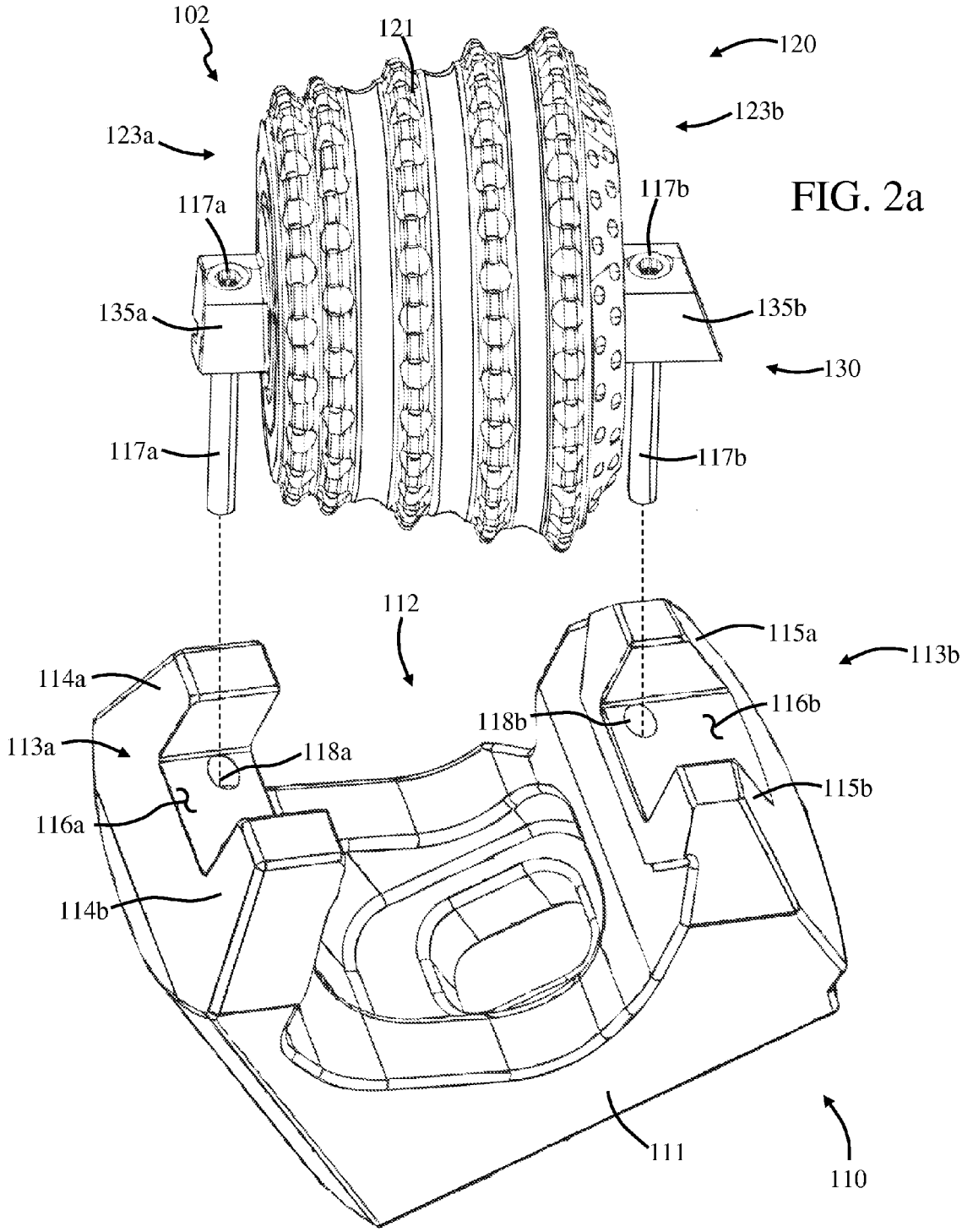
FIG. 2*a* is a perspective view of a cutter assembly of the raise boring reamer assembly of FIGS. 1*a* and 1*b* in an unassembled condition.
Figure 2B:
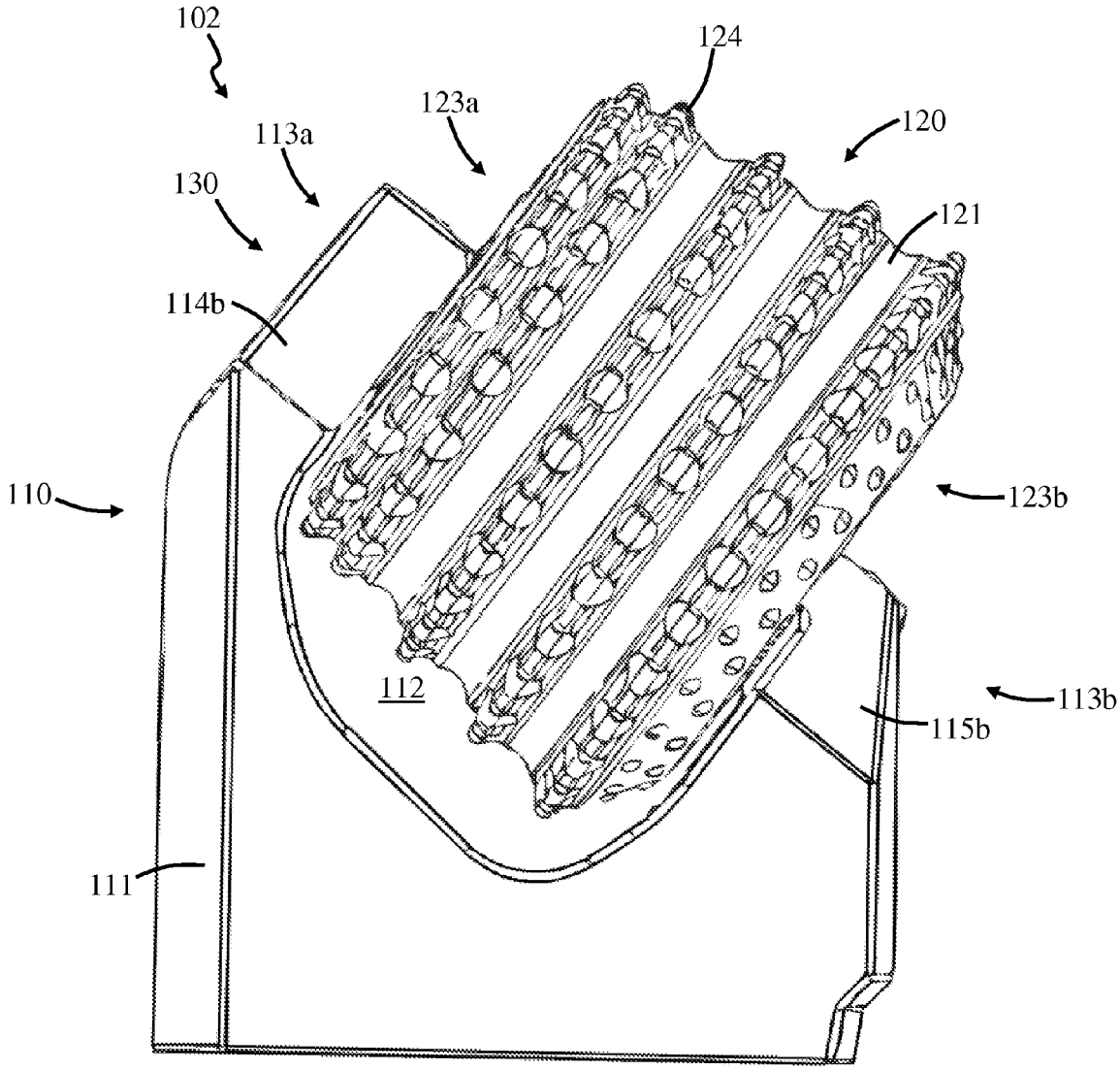
FIG. 2*b* is a side view of the cutter assembly of FIG. 2*a* in an assembled condition.
Figure 2C:
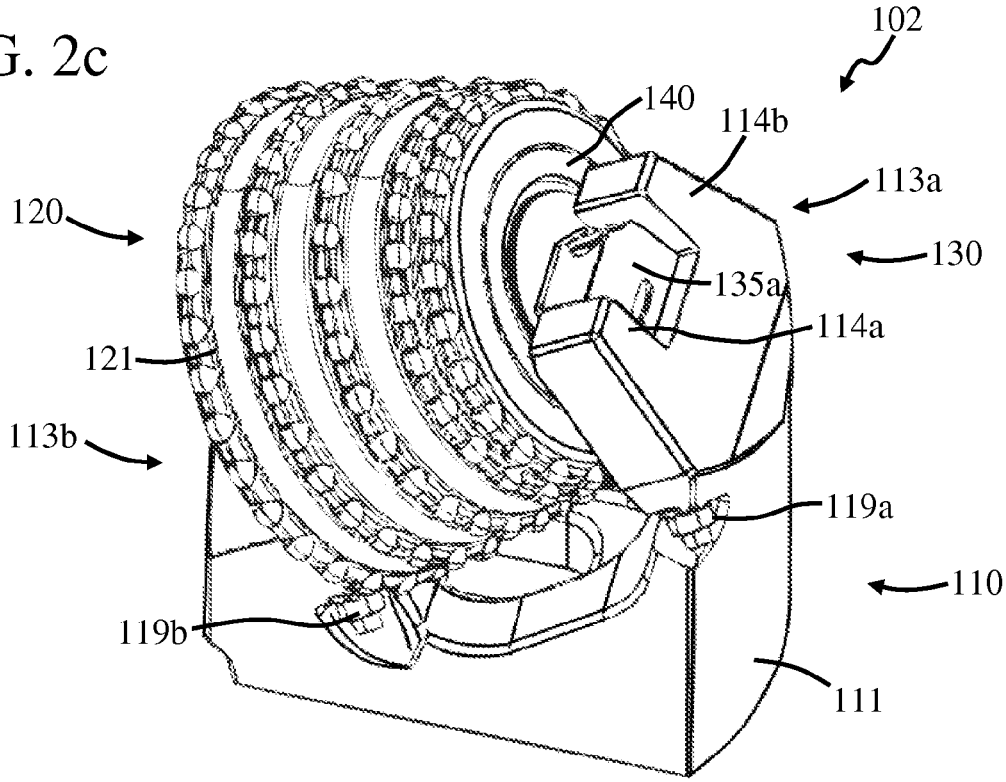
FIGS. 2*c* and 2*d* are perspective views of opposed sides of the cutter assembly of FIG. 2*b*.
Figure 2D:
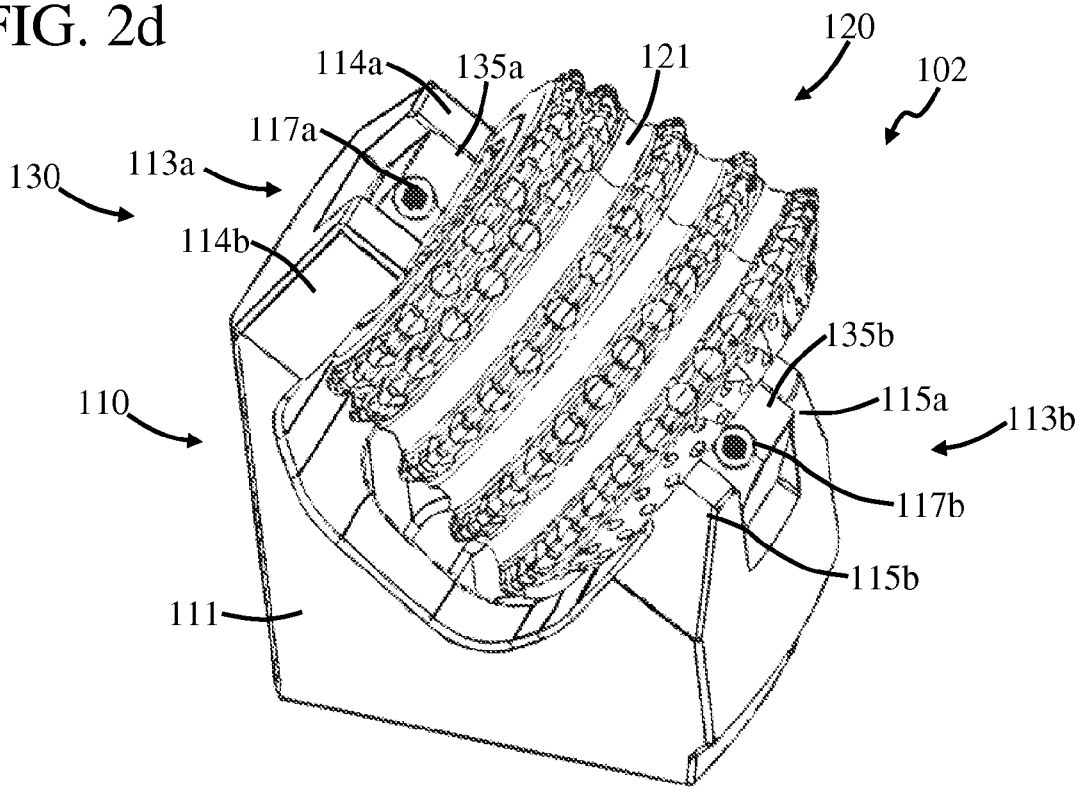
Figure 2E:
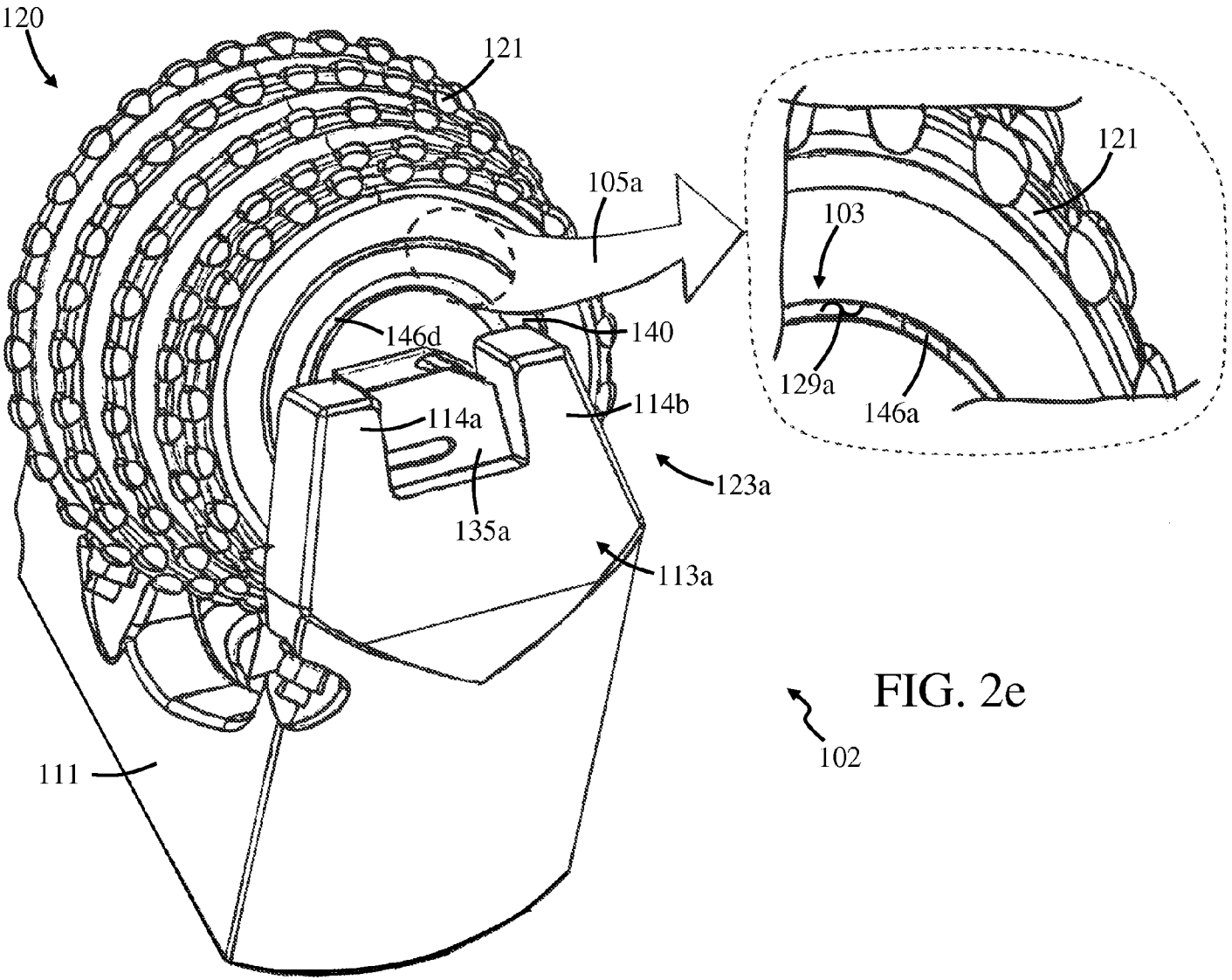
FIGS. 2*e* and 2*f* are opposed end views of the cutter assembly of FIG. 2*b*.
Figure 2F:
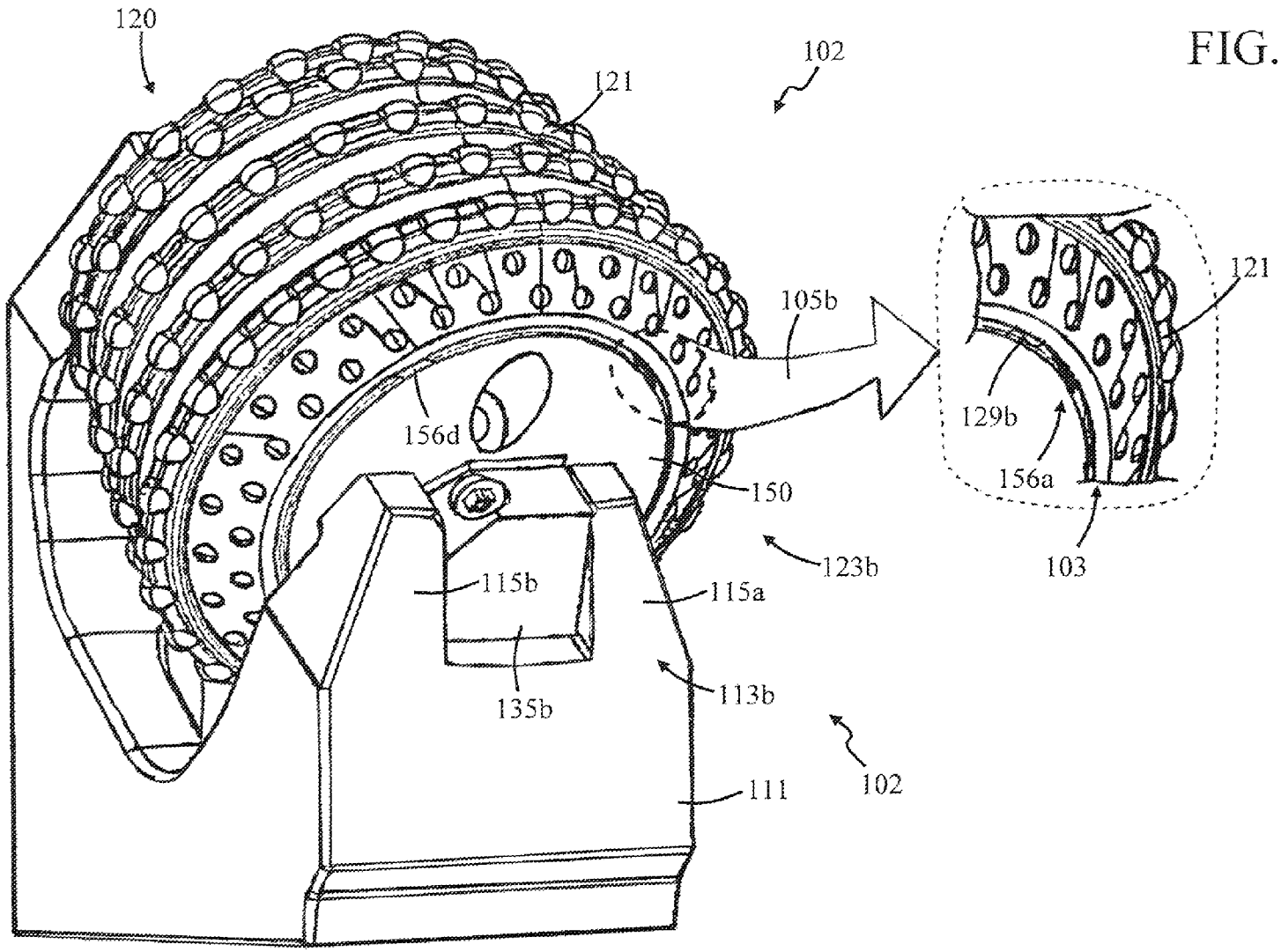

FIG. 2*a* is a perspective view of cutter assembly 102 in an unassembled condition, and FIG. 2*b* is a side view of cutter assembly 102 in an assembled condition. FIGS. 2*c* and 2*d* are perspective views of opposed sides of cutter assembly 102 of FIG. 2*b*, and FIGS. 2*e* and 2*f* are opposed end views of cutter assembly 102 of FIG. 2*b*.

Figure 3A:
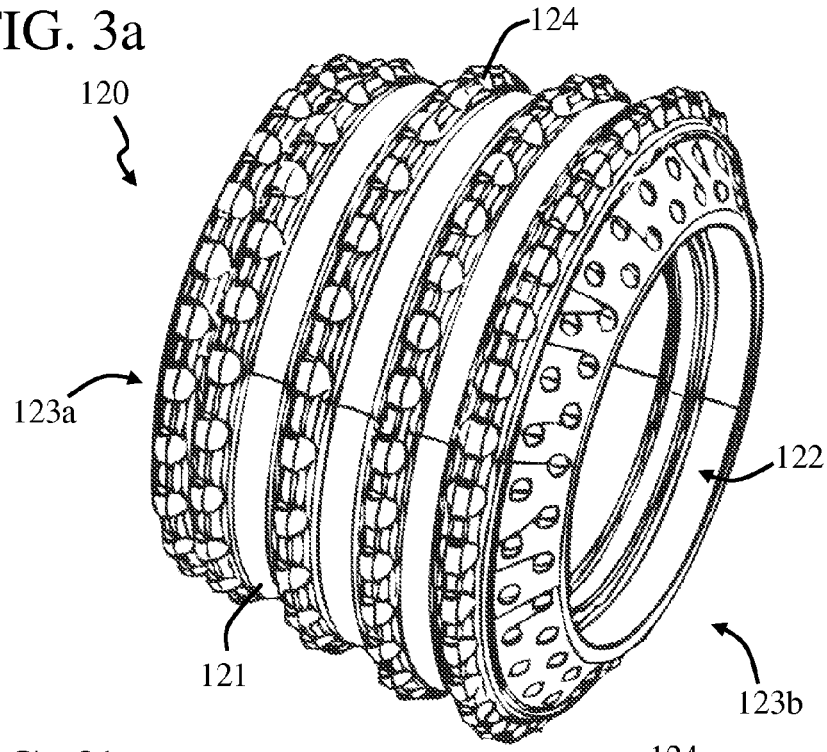
FIG. 3*a* is a perspective view of a cutter of the cutter assembly of FIG. 2*a*.
Figure 3B:
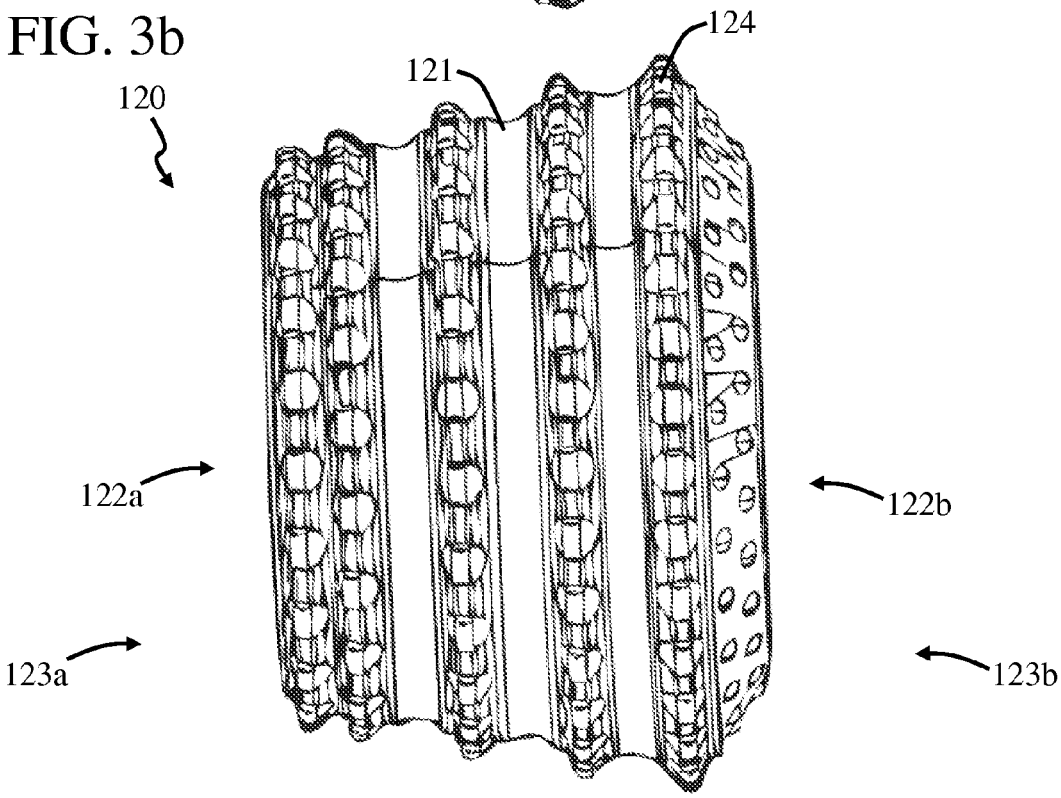
FIG. 3*b* is a side view of the cutter of FIG. 3*a*.

As shown in FIGS. 1*a* and 1*b* and FIGS. 2*a*-2*f*, cutter assembly 102 includes cutter 120, which is shown in a perspective view in FIG. 3*a*. FIG. 3*b* is a side view of cutter 120, and FIGS. 3*c* and 3*d* are opposed end views of cutter 120.

Figure 3C:
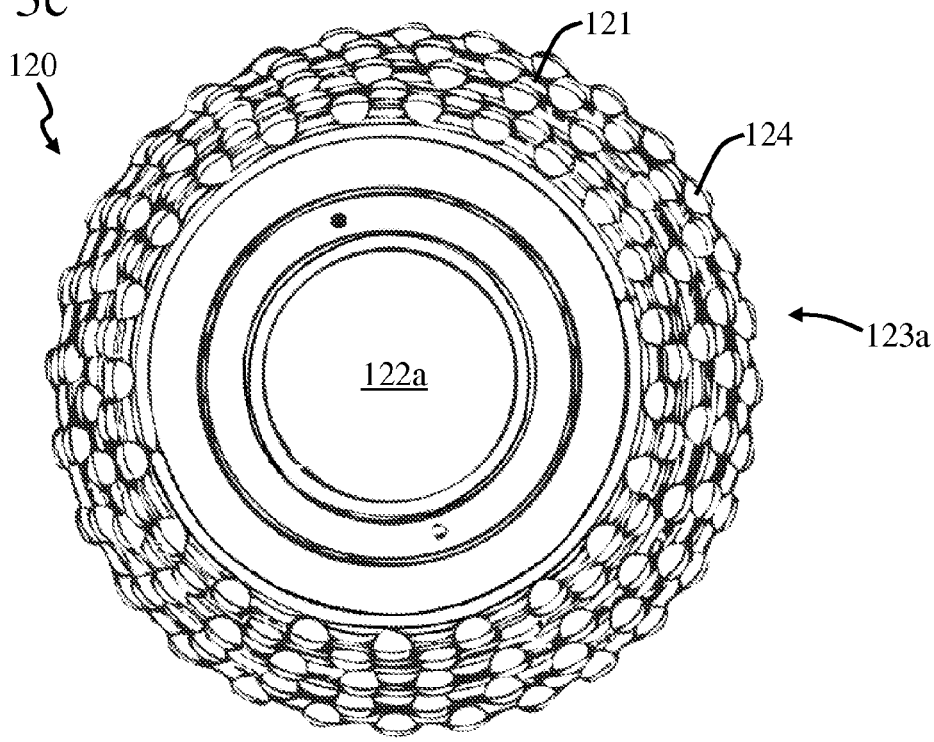
FIGS. 3*c* and 3*d* are opposed end views of the cutter of FIG. 3*a*.
Figure 3D:
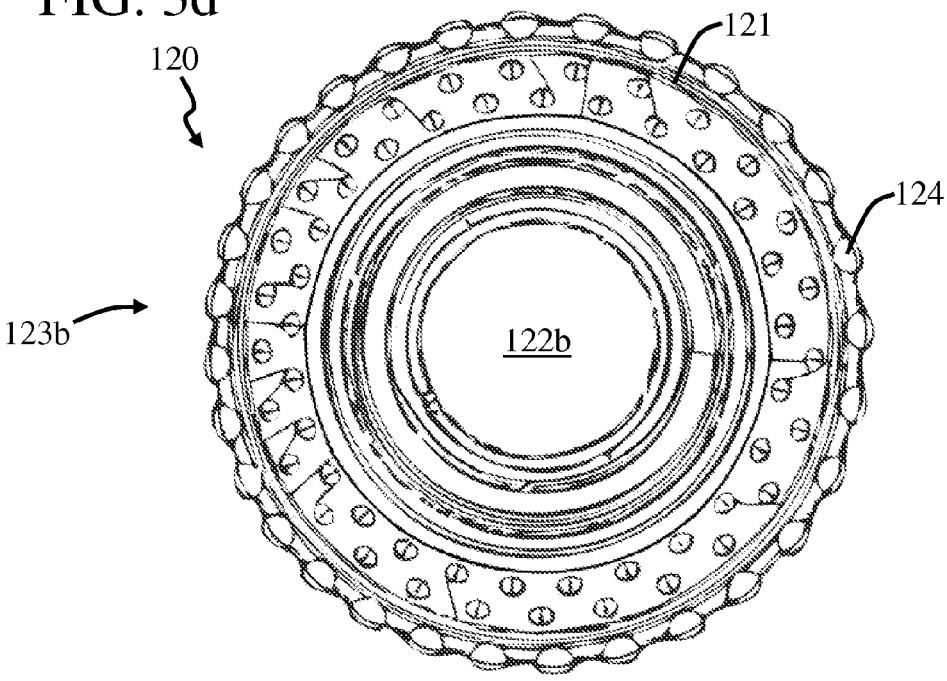

In this embodiment, cutter 120 includes a cutter body 121 having cutter body nose and gage ends 123*a* and 123*b*, which are shown in the opposed end views of FIGS. 3*c* and 3*d*, respectively. It should be noted that cutter body 121 has a larger outer dimension proximate to cutter body gage end 123*b* relative to an outer dimension proximate to cutter body nose end 123*a*. In this way, cutter body 121 has a frustoconical shape. Cutter 120 includes a plurality of cutter teeth 124, which extend annularly around an outer periphery of cutter body 121.

In this embodiment, cutter 120 includes a cutter body channel 122 which extends through cutter body 121 between opposed cutter body nose and gage ends 123*a* and 123*b*. Cutter body channel 122 includes opposed gage and nose channel openings 122*a* and 122*b* (FIGS. 3*b*, 3*c* and 3*d*) positioned proximate to cutter body nose and gage ends 123*a* and 123*b*, respectively.

Cutter body channel 122 is sized and shaped to receive journal assembly 130. A cutter bearing cavity 103 is formed in response to journal assembly 130 being received by cutter body channel 122, wherein cutter bearing cavity 103 is shown in FIGS. 2*e* and 2*f*. It should be noted that cutter bearing cavity 103 is shown in FIGS. 9*b* and 9*c* and will be discussed in more detail therewith. As indicated by indication arrows 105*a* and 105*b* in FIGS. 2*e* and 2*f*, respectively, cutter bearing cavity 103 extends between cutter 120 and journal assembly 130, as well as between nose and gage interface openings 129*a* and 129*b*. Nose and gage interface openings 129*a* and 129*b* extend annularly around journal assembly 130, and are proximate to nose and gage shanks 135*a* and 135*b*, respectively, of journal assembly 130.

It should be noted that journal assembly 130 extends through opposed gage and nose channel openings 122*a* and 122*b*. Journal assembly 130 extends through opposed gage and nose channel openings 122*a* and 122*b* because it extends away from cutter body channel 122 and cutter body nose and gage ends 123*a* and 123*b*. In particular, opposed nose and gage shanks 135*a* and 135*b* of journal assembly 130 extend beyond opposed nose and gage cutter body ends 123*a* and 123*b* of cutter 120. Further, journal assembly 130 extends through opposed gage and nose channel openings 122*a* and 122*b* because it is longer than cutter body channel 122. In this way, journal assembly 130 extends through opposed gage and nose channel openings 122*a* and 122*b*.

Figure 4A:
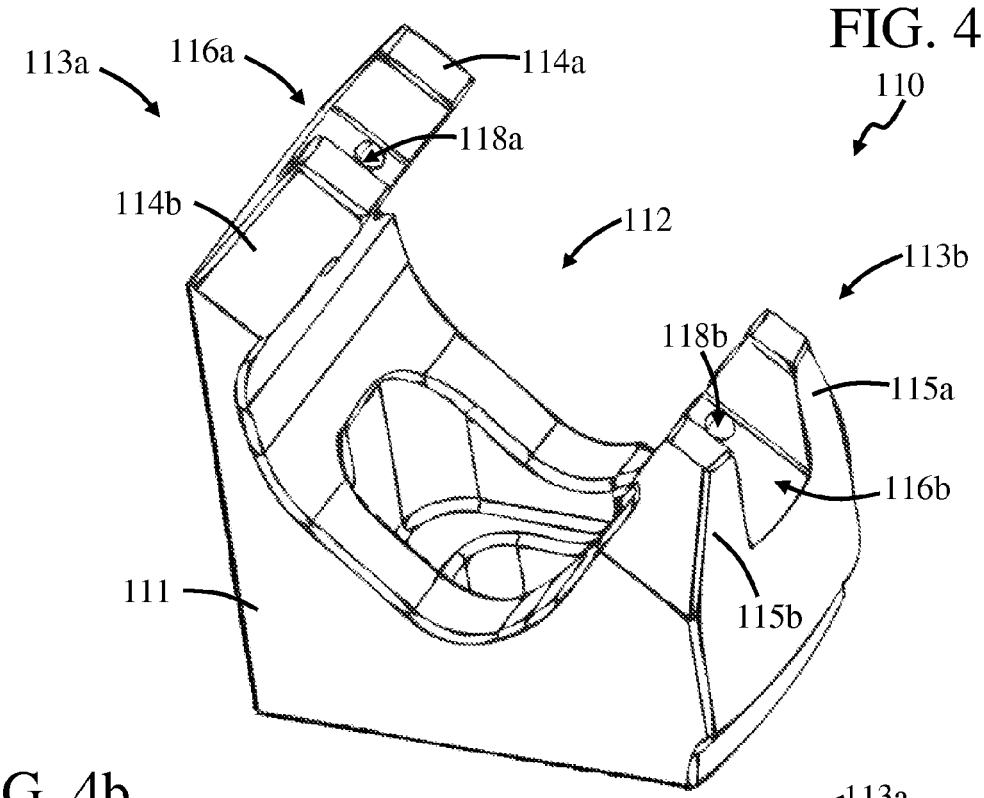
FIGS. 4*a* and 4*b* are opposed perspective views of a saddle of the cutter assembly of FIG. 2*a*.
Figure 4B:
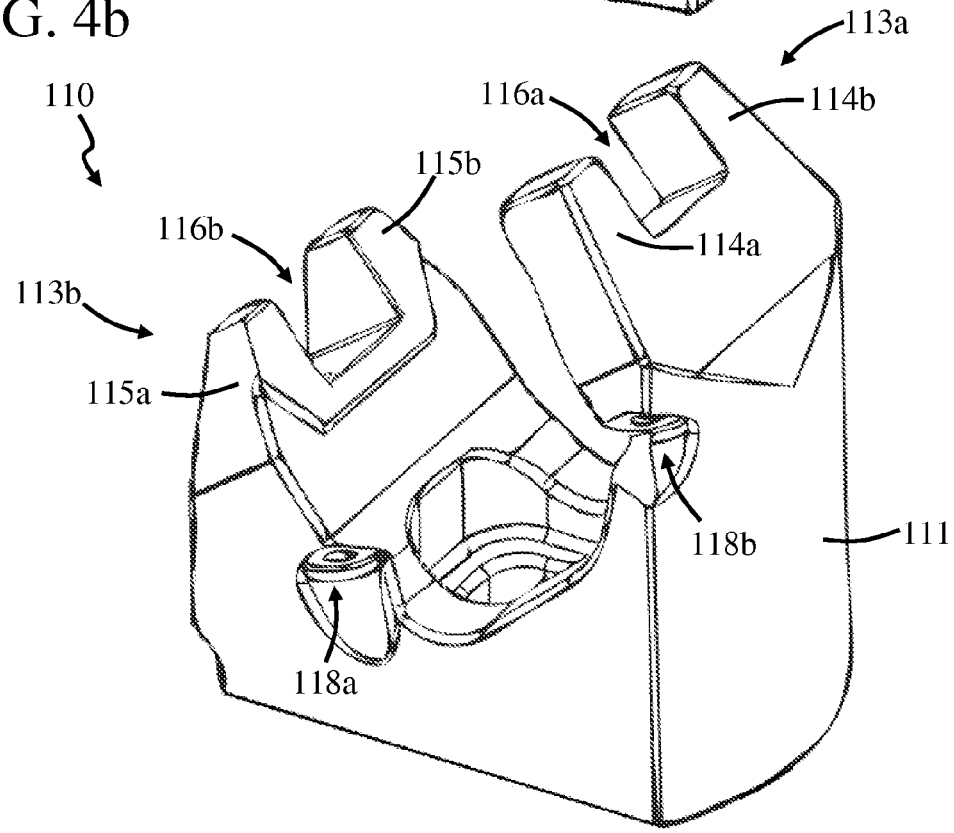
Figure 4C:
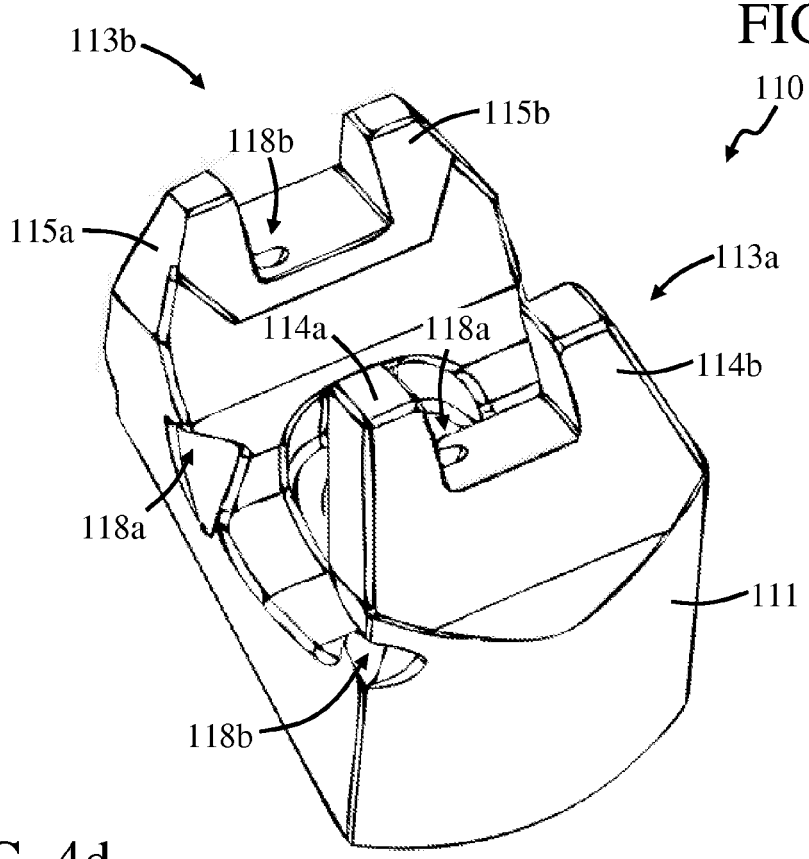
FIGS. 4*c* and 4*d* are perspective end and side views, respectively, of the saddle of FIG. 4*a*.
Figure 4D:
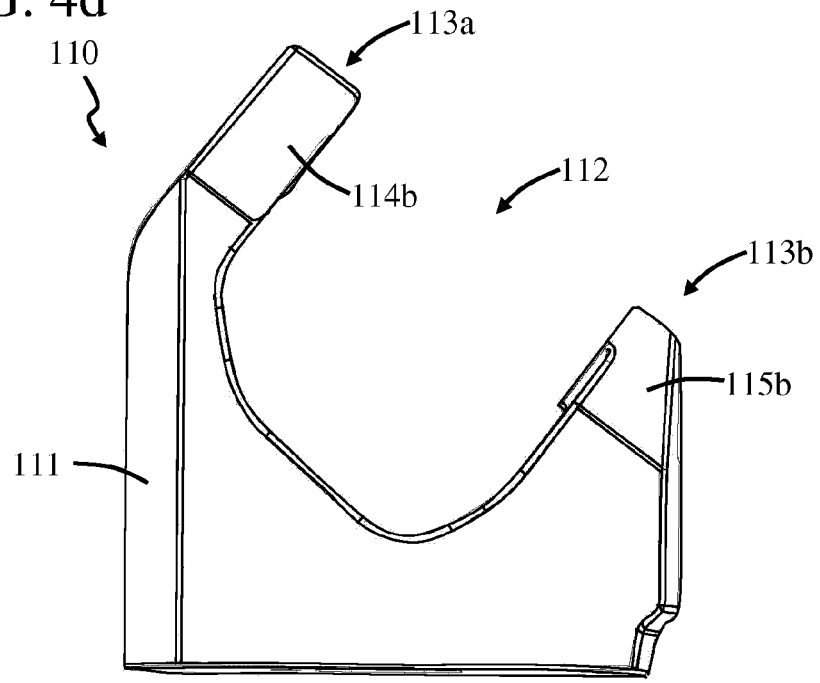

As shown in FIGS. 1*a* and 1*b* and FIGS. 2*a*-2*f*, cutter assembly 102 includes saddle 110, which is shown in opposed perspective views in FIGS. 4*a* and 4*b*. FIGS. 4*c* and 4*d* are perspective end and side views, respectively, of saddle 110.

In this embodiment, saddle 110 includes a saddle body 111 having a cutter recess 112 extending therethrough. Cutter recess 112 is sized and shaped to receive cutter 120, as shown in FIGS. 2*b*-2*f*.

In this embodiment, saddle body 111 includes nose and gage shank couplers 113*a* and 113*b* positioned proximate to opposed sides of cutter recess 112. As will be discussed in more detail below, cutter 120 is rotatably mounted to journal assembly 130, and journal assembly 130 is coupled to nose and gage shank couplers 113*a* and 113*b* so cutter 120 and journal assembly 130 extend through cutter recess 112 (FIGS. 2*a*-2*f*). In this way, cutter 120 is received by cutter recess 112, and is rotatably mounted therein.

Figure 5A:
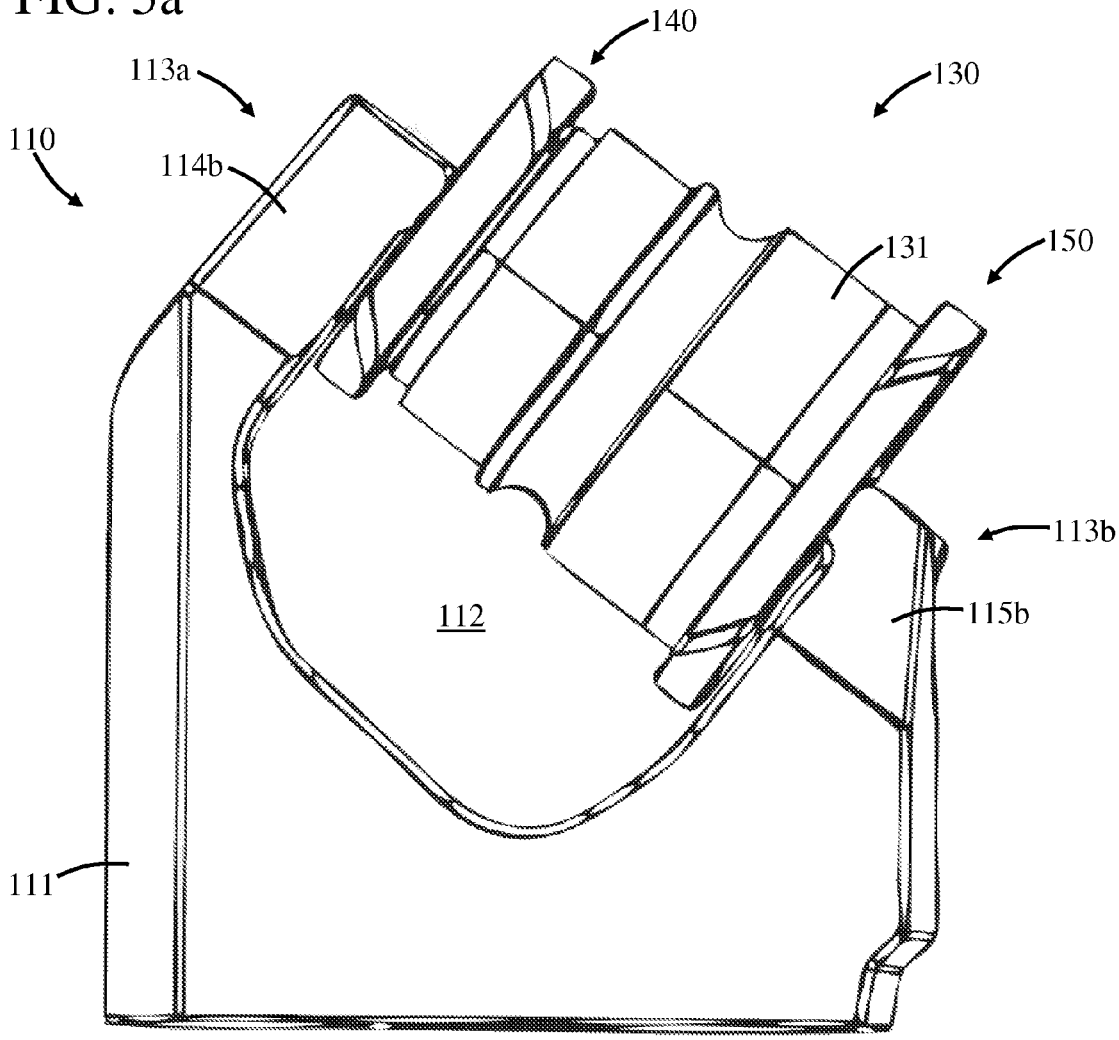
FIG. 5*a* is a side view of a journal assembly of FIGS. 1*a* and 1*b* mounted to the saddle of FIGS. 4*a* and 4*b*.
Figure 5B:
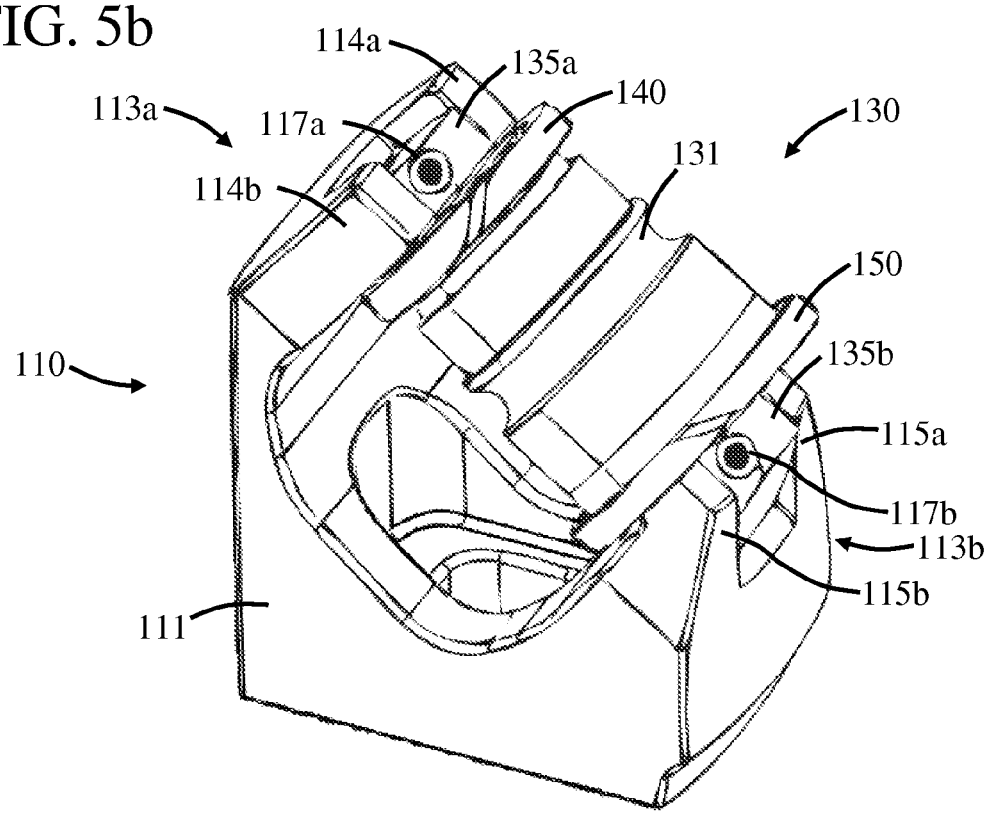
FIGS. 5*b* and 5*c* are perspective views of opposed sides of the journal assembly of FIGS. 1*a* and 1*b* mounted to the saddle of FIGS. 4*a* and 4*b*.
Figure 5C:
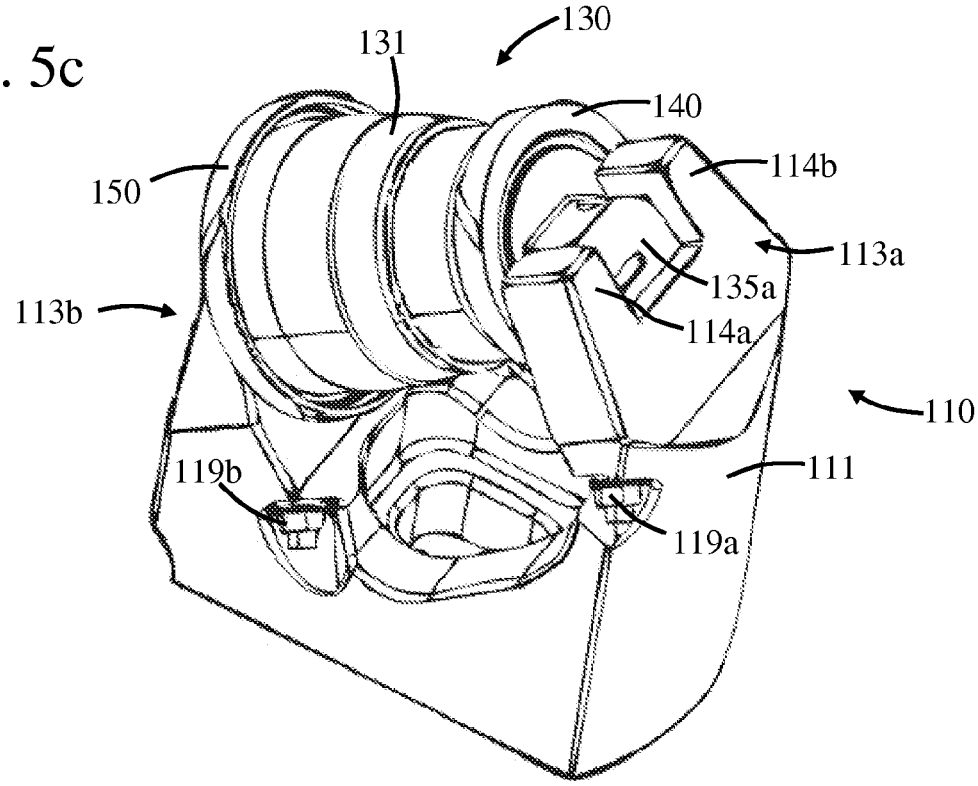

FIG. 5*a* is a side view of journal assembly 130 mounted to saddle 110, and FIGS. 5*b* and 5*c* are perspective views of opposed sides of journal assembly 130 mounted to saddle 110. As shown in FIGS. 4*a*, 4*b* and 4*c*, nose shank coupler 113*a* includes a nose shank coupler recess 116*a* positioned between nose shank coupler arms 114*a* and 114*b*. As shown in FIGS. 2*d*, 5*b* and 5*c*, nose shank coupler recess 116*a* is sized and shaped to receive a nose shank 135*a* of journal assembly 130.

In this embodiment, nose shank coupler 113*a* includes a nose bolt opening 118*a*, which extends through saddle body 111 between nose shank coupler arms 114*a* and 114*b*. As will be discussed in more detail below, nose bolt opening 118*a* is sized and shaped to receive a nose bolt 117*a* which holds nose shank 135*a* to saddle body 111 (FIGS. 2*a* and 2*d*). Nose bolt 117*a* is held to saddle body 111 by a nut 119*a*, as shown in FIGS. 2*c* and 5*c*. Nose bolt opening 118*a* is aligned with a nose shank opening 136*a* (FIG. 6*b*) of nose shank 135*a* in response to nose shank 135*a* being received by nose shank coupler recess 116*a*.

As shown in FIGS. 4*a*, 4*b* and 4*c*, gage shank coupler 113*b* includes a gage shank coupler recess 116*b* positioned between gage shank coupler arms 115*a* and 115*b*. As shown in FIGS. 2*d* and 5*b*, gage shank coupler recess 116*b* is sized and shaped to receive a gage shank 135*b* of journal assembly 130.

In this embodiment, gage shank coupler 113*b* includes a gage bolt opening 118*b*, which extends through saddle body 111 between gage shank coupler arms 115*a* and 115*b*. As will be discussed in more detail below, gage bolt opening 118*b* is sized and shaped to receive a gage bolt 117*b* which holds gage shank 135*b* to saddle body 111. Gage bolt 117*b* is held to saddle body 111 by a nut 119*b*, as shown in FIGS. 2*c* and 5*c*. Gage bolt opening 118*b* is aligned with a gage shank opening 136*b* of gage shank 135*b* (FIG. 6*a*) in response to gage shank 135*b* being received by gage shank coupler recess 116*b*.

Figure 6A:
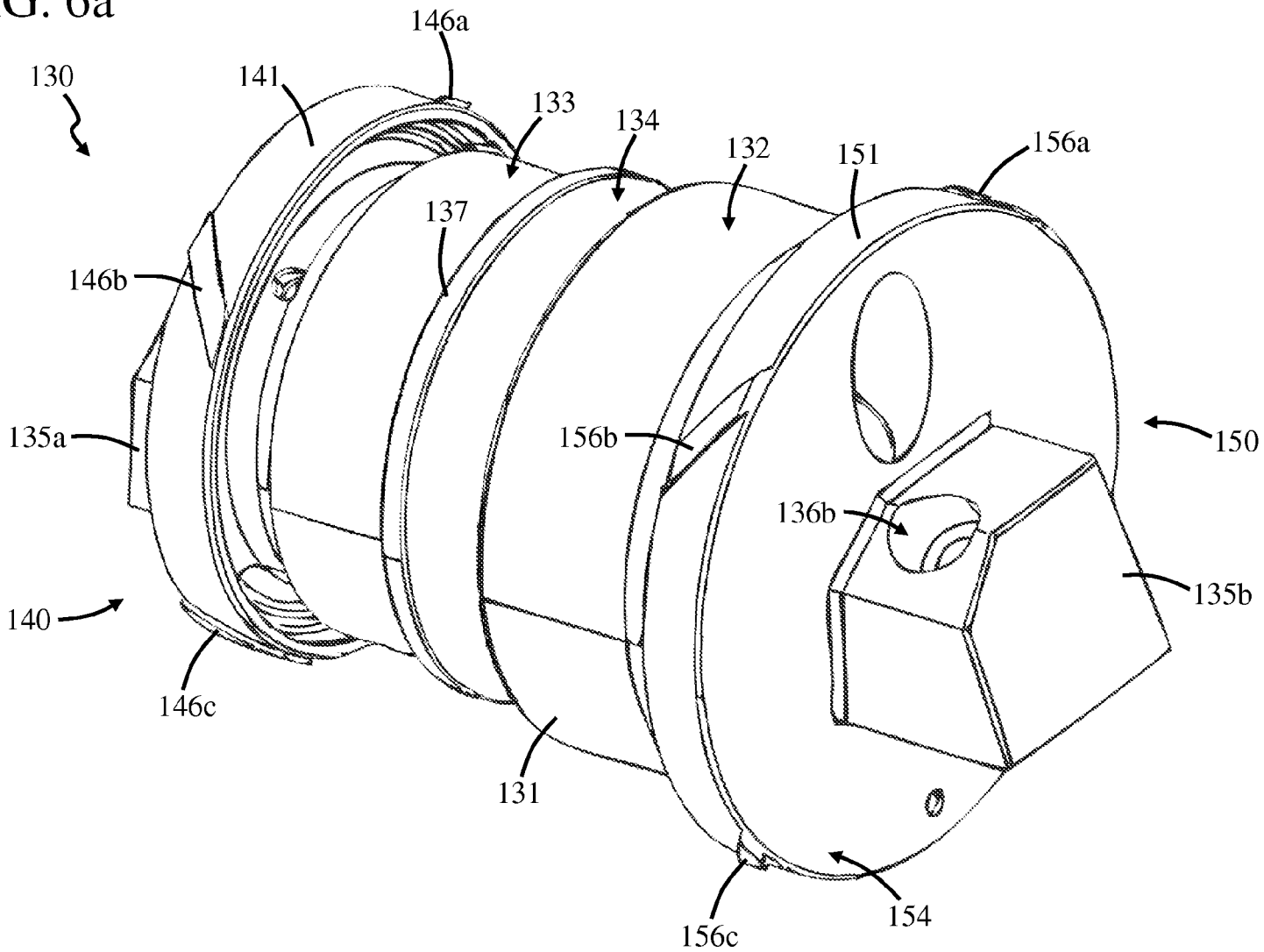
FIGS. 6*a* and 6*b* are opposed perspective views of the journal assembly of FIG. 5*a*.
Figure 6B:
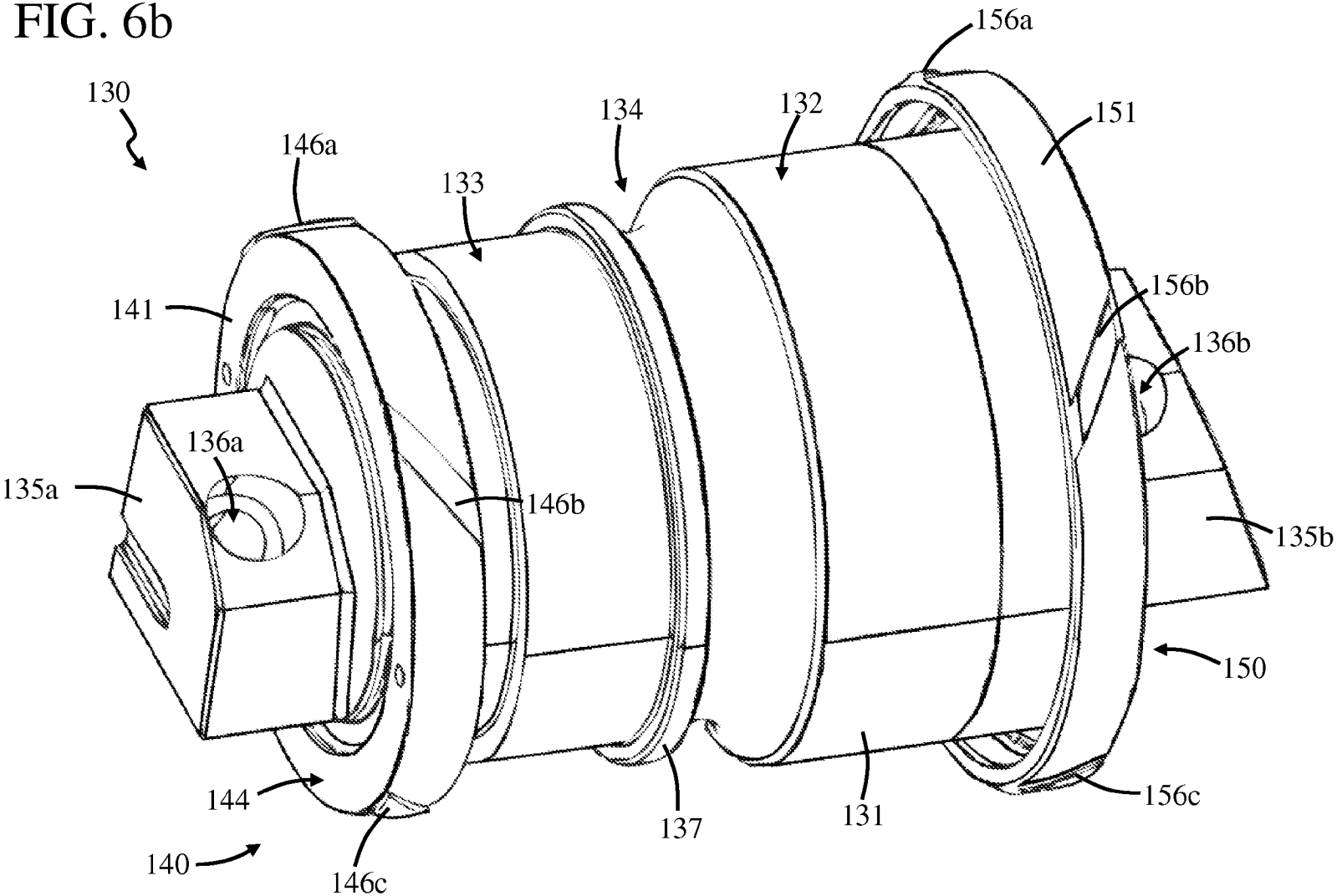
Figure 6C:
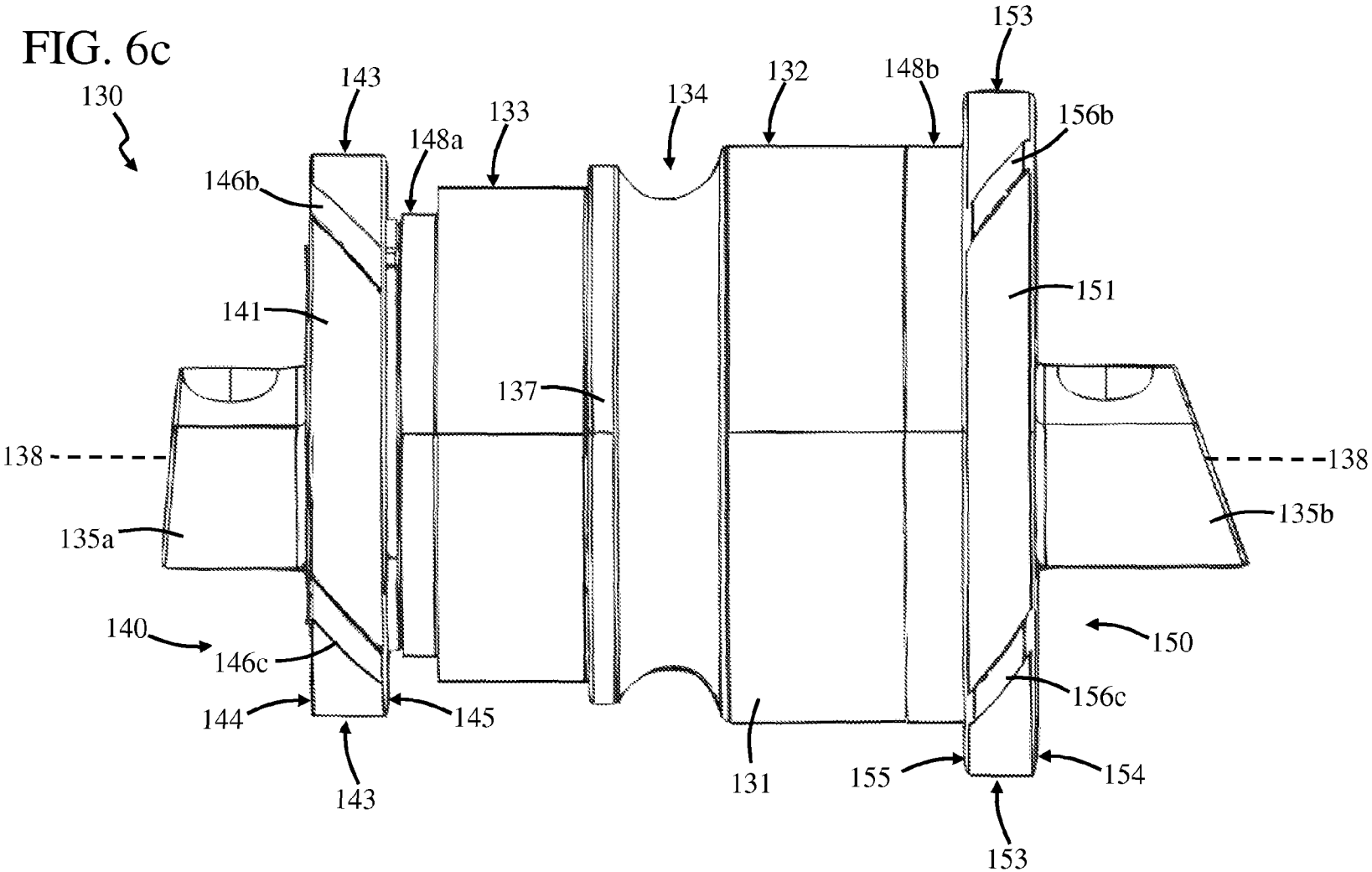
FIG. 6*c* is a side view of the journal assembly of FIGS. 6*a* and 6*b*.

As shown in FIGS. 1*a* and 1*b* and FIGS. 2*a*-2*f*, cutter assembly 102 includes journal assembly 130, which is shown in opposed perspective views in FIGS. 6*a* and 6*b*, and in a side view in FIG. 6*c*.

In this embodiment, journal assembly 130 includes a journal body 131 having nose and gage shanks 135*a* and 135*b* positioned at opposed ends. Journal body 131 is shown in opposed perspective views in FIGS. 6*d* and 6*e*, and in a side view in FIG. 6*f*.

In this embodiment, nose and gage shanks 135*a* and 135*b* are integrated with journal body 131. In this way, journal body 131 and nose and gage shanks 135*a* and 135*b* are a single piece of material. In other embodiments, nose and gage shanks 135*a* and 135*b* are separate pieces of material that are coupled to journal body 131 at opposed ends.

Nose and gage shanks 135*a* and 135*b* are sized and shaped to be received by nose and gage shank coupler recesses 116*a* and 116*b*, respectively, as shown in FIGS. 2*a*, 2*d*, 5*b* and 5*c*. In particular, nose shank 135*a* is sized and shaped to be received by nose shank coupler recess 116*a* between nose shank coupler arms 114*a* and 114*b*. Further, gage shank 135*b* is sized and shaped to be received by gage shank coupler recess 116*b* between gage shank coupler arms 115*a* and 115*b*.

In this embodiment, nose and gage shanks 135*a* and 135*b* include nose and gage shank openings 136*a* and 136*b*, respectively, which extend therethrough. As mentioned above, nose and gage shank openings 136*a* and 136*b* are sized and shaped to receive nose and gage bolts 117*a* and 117*b*, respectively (FIG. 2*a*). Nose shank opening 136*a* is aligned with nose bolt opening 118*a* in response to nose shank 135*a* being received by nose shank coupler recess 116*a*. Further, gage shank opening 136*b* is aligned with gage bolt opening 118*b* in response to gage shank 135*b* being received by gage shank coupler recess 116*b*. Nose and gage bolts 117*a* and 117*b* hold journal assembly 130 to saddle 110 (FIG. 2*d*). In this way, journal assembly 130 is mounted to saddle 110 in a repeatably removeable manner.

In this embodiment, journal body 131 includes gage and nose roller bearing surfaces 132 and 133, and a ball bearing groove 134 positioned therebetween. Gage and nose roller bearing surfaces 132 and 133 are annular surfaces which extend annularly around journal body 131. Further, ball bearing groove 134 is an annular groove which extends annularly around journal body 131. Journal body 131 includes an annular protrusion 137 which is positioned between nose roller bearing surface 133 and ball bearing groove 134. It should be noted that gage roller bearing surface 132 is positioned between ball bearing groove 134 and gage shank 135*b*, and nose roller bearing surface 133 is positioned between annular protrusion 137 and nose shank 135*a*.

Figure 6D:
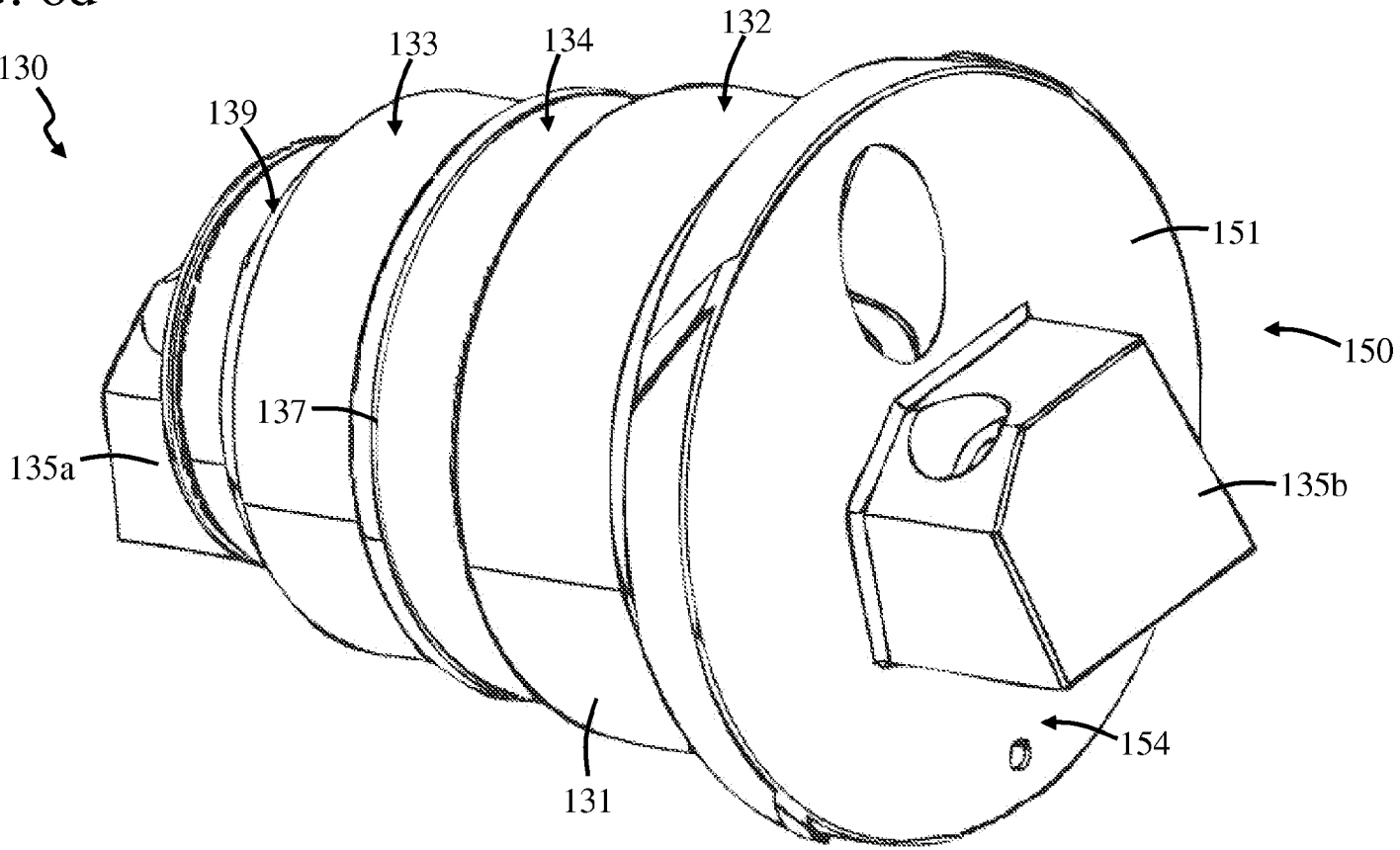
FIGS. 6*d* and 6*e* are in opposed perspective views of a journal body of the journal assembly of FIGS. 6*a* and 6*b*.
Figure 6E:
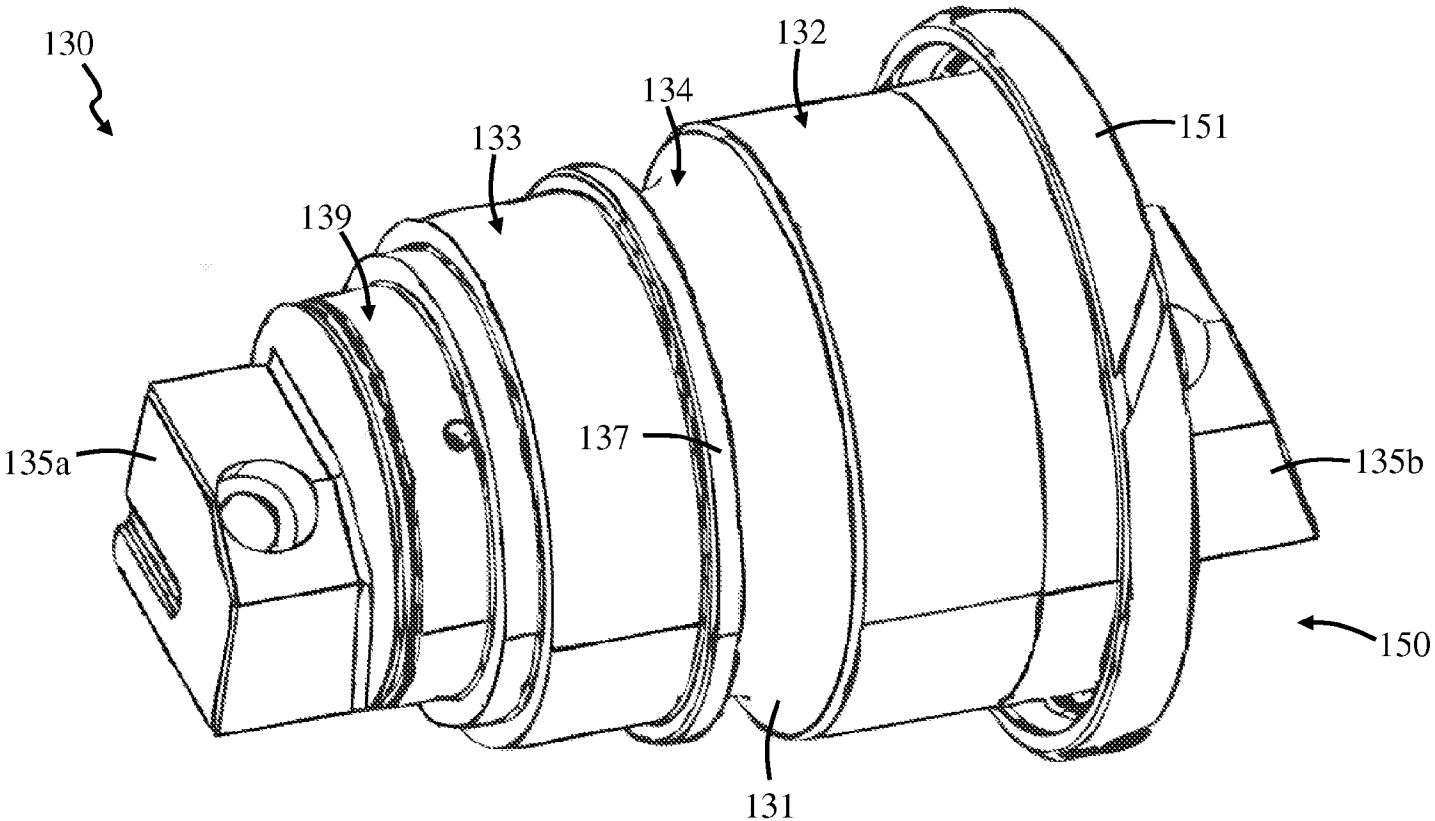
Figure 6F:
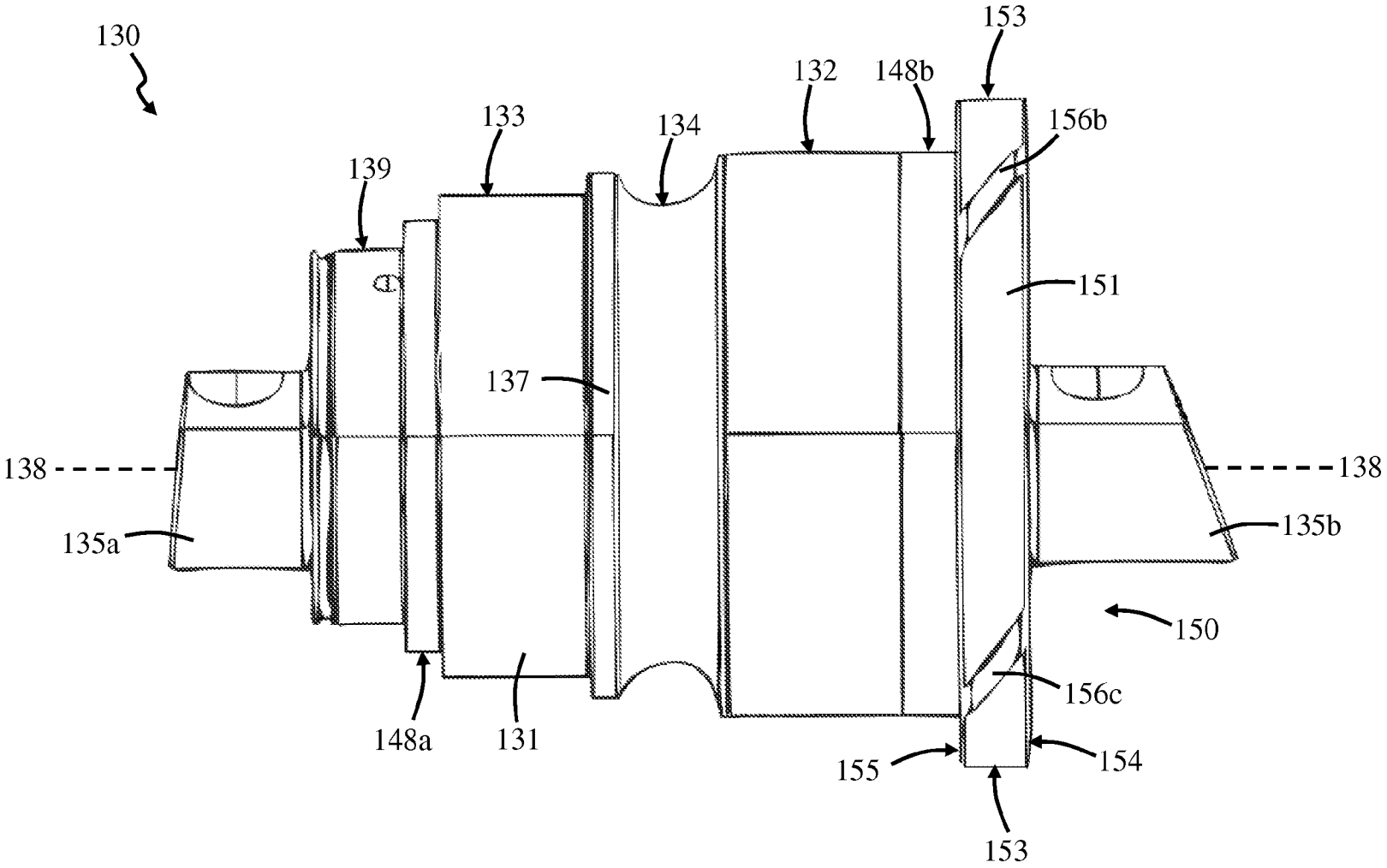
FIG. 6*f* is a side view of the journal body of FIGS. 6*d* and 6*e*.

As will be discussed in more detail below, gage and nose roller bearing surfaces 132 and 133 are engaged by roller bearings positioned between journal body 131 and cutter 120. Further, ball bearing groove 134 is engaged by a ball bearing positioned between cutter 120 and journal body 131. The ball and roller bearings facilitate the ability of cutter 120 to rotate relative to journal assembly 130. It should be noted that cutter 120 rotates about a longitudinal journal axis 138, as shown in FIGS. 6*c* and 6*f*. Hence, longitudinal journal axis 138 corresponds to an axis of rotation of cutter 120.

In this embodiment, journal body 131 includes nose and gage seal assembly surfaces 148*a* and 148*b*, which are shown in FIGS. 6*c* and 6*f*. Nose seal assembly surface 148*a* is positioned between nose shank 135*a* and nose roller bearing surface 133, and gage seal assembly surface 148*b* is positioned between gage shank 135*b* and gage roller bearing surface 132. Nose and gage seal assembly surfaces 148*a* and 148*b* are engaged by a nose and gage seal assemblies 170 and 171, which are shown in FIGS. 9*b* and 9*c*. Nose and gage seal assemblies establish a seal between journal body 131 and cutter 120.

In this embodiment, journal assembly 130 includes a nose wiper ring 140 positioned proximate to nose shank 135*a* and away from gage shank 135*b* (FIGS. 6*a*, 6*b* and 6*c*). In particular, nose wiper ring 140 is positioned between nose roller bearing surface 133 and nose shank 135*a*. In this embodiment, nose wiper ring 140 is coupled to journal body 131 so it is repeatably removeable therefrom. In particular, nose wiper ring 140 is coupled to journal body 131 so it engages a journal nose wiper ring surface 139, which is shown in FIGS. 6*d*, 6*e* and 6*f*. Nose wiper ring 140 can be coupled to journal body 131 so it is repeatably removeable therefrom in many different ways, such as by using one or more fasteners which fasten it to journal body 131. In other embodiments, nose wiper ring 140 is integrated with journal body 131 so they are a single piece of material.

In this embodiment, nose wiper ring 140 moves debris away from cutter bearing cavity 103. In particular, nose wiper ring 140 moves debris away from cutter bearing cavity 103 in response to the rotation of cutter 120. In this embodiment, nose wiper ring 140 moves debris through nose interface opening 129*a* and towards nose shank 135*a*. In particular, nose wiper ring 140 moves debris through nose interface opening 129*a* and towards nose shank 135*a* in response to the rotation of cutter 120. In this embodiment, nose wiper ring 140 moves debris away from nose roller bearing surface 133. In particular, nose wiper ring 140 moves debris away from nose roller bearing surface 133 in response to the rotation of cutter 120. In this embodiment, nose wiper ring 140 moves debris towards nose shank 135*a*. In particular, nose wiper ring 140 moves debris towards nose shank 135*a* in response to the rotation of cutter 120. Nose wiper ring 140 can move debris away from cutter bearing cavity 103, nose roller bearing surface 133 and towards nose shank 135*a* in many different ways, one of which will be discussed in more detail presently.

Figure 7A:
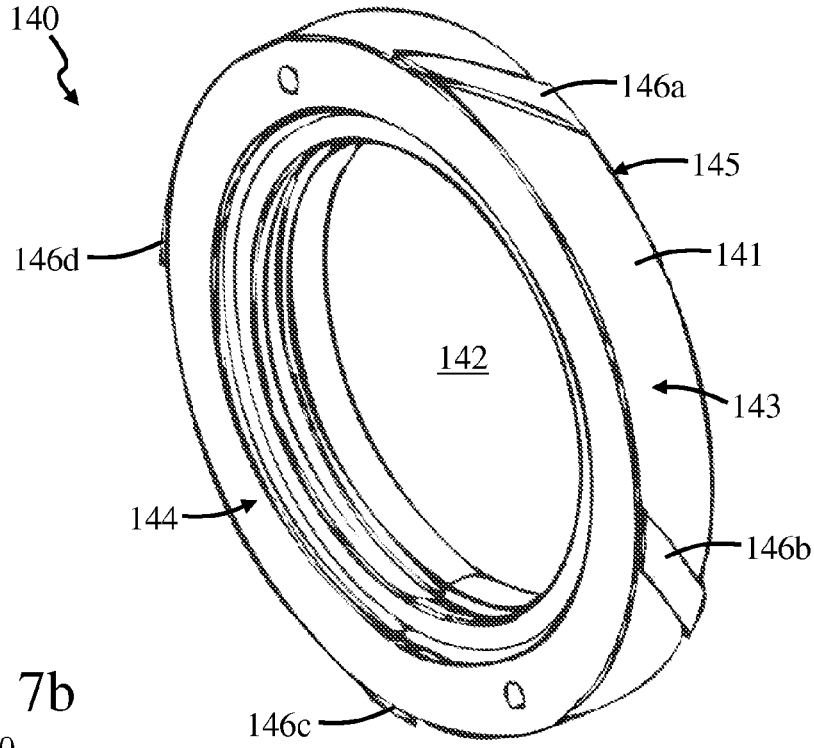
FIGS. 7*a* and 7*b* are opposed perspective views of a nose wiper ring of the journal assembly of FIGS. 6*a* and 6*b*.
Figure 7B:
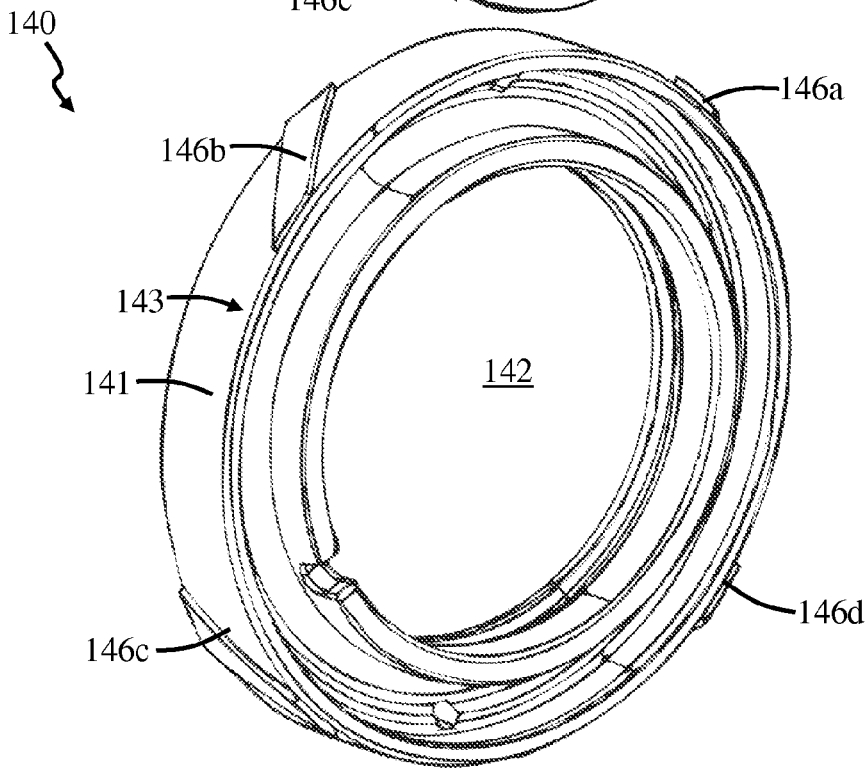
Figure 7C:
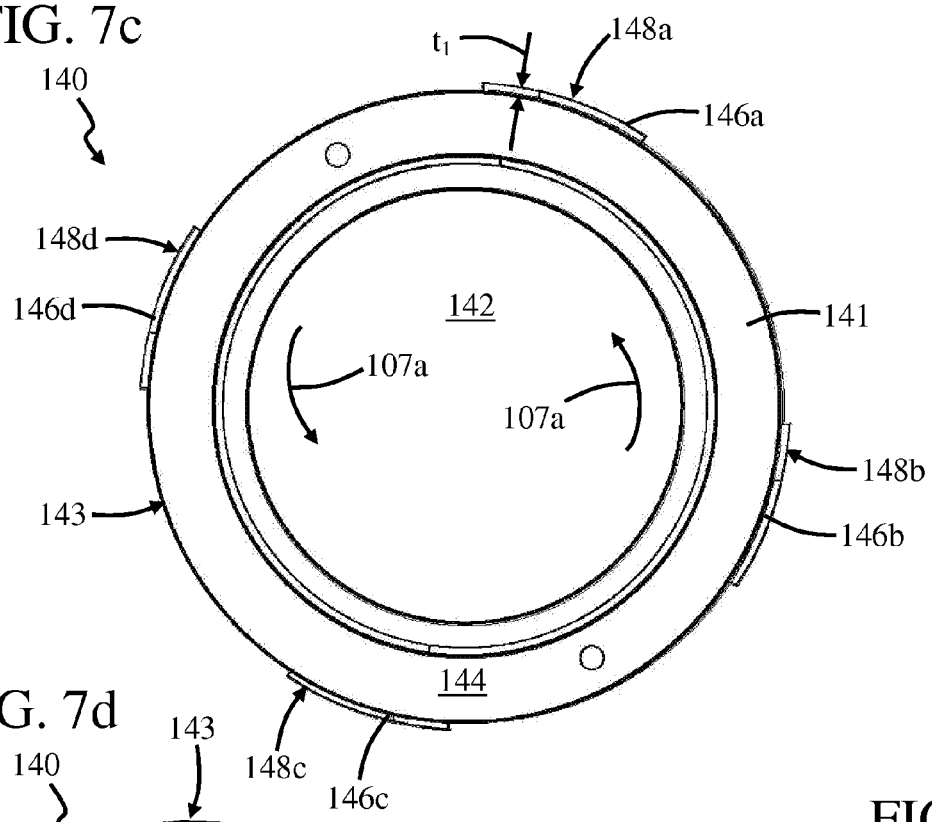
FIG. 7*c* is a front side view of the nose wiper ring of FIGS. 7*a* and 7*b*.
Figure 7D:
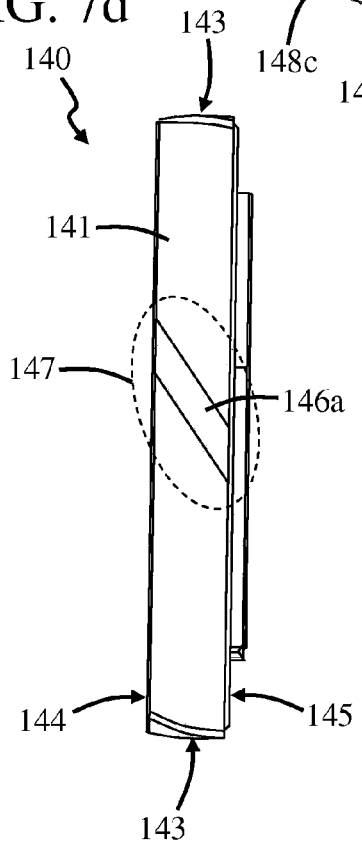
FIG. 7*d* is a side view of the nose wiper ring of FIGS. 7*a* and 7*b*.
Figure 7E:
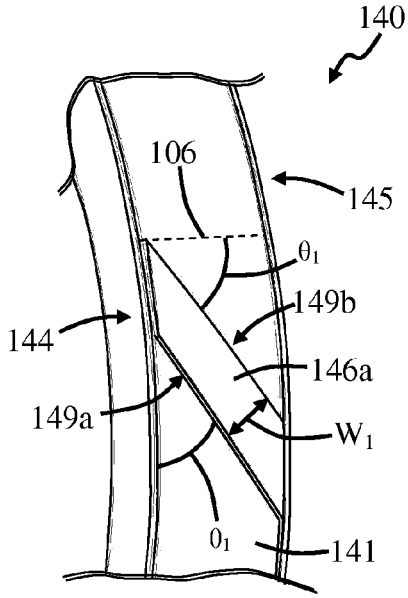
FIG. 7*e* is a close-up perspective view of the nose wiper ring of FIGS. 7*a* and 7*b*.

FIGS. 7*a* and 7*b* are opposed perspective views of nose wiper ring 140. FIGS. 7*c* and 7*d* are front and side views, respectively, of nose wiper ring 140, and FIG. 7*e* is a close-up perspective view of nose wiper ring 140.

In this embodiment, nose wiper ring 140 includes an annularly shaped wiper ring body 141, which has a wiper ring body opening 142 extending therethrough. Wiper ring body opening 142 extends between opposed outer wiper ring surface edges 144 and 145, which are shown in FIG. 7*d*. It should be noted that, as shown in FIG. 6*c*, outer wiper ring surface edge 144 faces nose shank 135*a*, and outer wiper ring surface edge 145 faces away from nose shank 135*a*. Wiper ring body 141 includes an outer wiper ring surface 143, which extends annularly around the outer periphery thereof and faces away from wiper ring body opening 142. Outer wiper ring surface 143 extends between opposed outer wiper ring surface edges 144 and 145.

In this embodiment, wiper ring 140 includes four wipers, which are denoted as wipers 146*a*, 146*b*, 146*c* and 146*d* and are carried by nose wiper ring body 141. It should be noted that wiper ring 140 generally includes one or more wipers carried by nose wiper ring body 141. In this embodiment, four wipers are shown for illustrative purposes.

In this embodiment, wipers 146*a*, 146*b*, 146*c* and 146*d* move debris away from cutter bearing cavity 103. In particular, wipers 146*a*, 146*b*, 146*c* and 146*d* move debris away from cutter bearing cavity 103 in response to the rotation of cutter 120. In this embodiment, wipers 146*a*, 146*b*, 146*c* and 146*d* move debris through nose interface opening 129*a* and towards nose shank 135*a*. In particular, wipers 146*a*, 146*b*, 146*c* and 146*d* move debris through nose interface opening 129*a* and towards nose shank 135*a* in response to the rotation of cutter 120. In this embodiment, wipers 146*a*, 146*b*, 146*c* and 146*d* move debris away from nose roller bearing surface 133. In particular, wipers 146*a*, 146*b*, 146*c* and 146*d* move debris away from nose roller bearing surface 133 in response to the rotation of cutter 120. In this embodiment, wipers 146*a*, 146*b*, 146*c* and 146*d* move debris towards nose shank 135*a*. In particular, wipers 146*a*, 146*b*, 146*c* and 146*d* move debris towards nose shank 135*a* in response to the rotation of cutter 120. In this way, nose wiper ring 140 moves debris away from cutter bearing cavity 103, nose roller bearing surface 133 and towards nose shank 135*a*. It should be noted that the direction of rotation of cutter 120 is in a counter-clockwise direction 107*a*, which is indicated in FIG. 7*c*.

As mentioned above, wipers 146*a*, 146*b*, 146*c* and 146*d* are carried by wiper ring body 141. Wipers 146*a*, 146*b*, 146*c* and 146*d* can be carried by wiper ring body 141 in many different ways so they move debris away from cutter bearing cavity 103, nose roller bearing surface 133 and towards nose shank 135*a* in response to the rotation of cutter 120 relative to journal assembly 130. In this embodiment, wipers 146*a*, 146*b*, 146*c* and 146*d* are positioned proximate to outer wiper ring surface 143 so they face cutter 120. In particular, wipers 146*a*, 146*b*, 146*c* and 146*d* are engaged with outer wiper ring surface 143 so they face cutter 120, and extend between opposed outer wiper ring surface edges 144 and 145.

In this embodiment, wipers 146*a*, 146*b*, 146*c* and 146*d* include wiper surfaces 148*a*, 148*b*, 148*c* and 148*d*, respectively, as shown in FIG. 7*c*. Wiper surfaces 148*a*, 148*b*, 148*c* and 148*d* face away from wiper ring body opening 142 and outer wiper ring surface 143. It should be noted that wiper surfaces 148*a*, 148*b*, 148*c* and 148*d* curve in response to the curvature of outer wiper ring surface 143. Wiper surfaces 148*a*, 148*b*, 148*c* and 148*d* are each spaced from outer wiper ring surface 143. In this embodiment, wiper surfaces 148*a*, 148*b*, 148*c* and 148*d* are each spaced from outer wiper ring surface 143 by a distance $t_1$, as shown in FIG. 7*c*. Further, wiper surfaces 148*a*, 148*b*, 148*c* and 148*d* each have a width of $W_I$, which is a distance between the leading and trailing surfaces of the corresponding wipers 146*a*, 146*b*, 146*c* and 146*d*. For example, width $W_1$ extends between leading and trailing surfaces 149*a* and 149*b* of wiper 146*a*, as shown in FIG. 7*e*. Edges 149*a* and 149*b* are leading and trailing edges, respectively, because cutter 120 rotates about journal assembly 130 from edge 149*a* to edge 149*b*. In some embodiments, width $W_1$ is between about five times to about ten times the value of thickness $t_1$.

It should be noted that wipers 146*a*, 146*b*, 146*c* and 146*d* extend between outer wiper ring surface edges 144 and 145 so that their lengths are not parallel to a reference line 106. Reference line 106 extends perpendicular to outer wiper ring surface edges 144 and 145. The lengths of wipers 146*a*, 146*b*, 146*c* and 146*d* are not parallel to reference line 106 because leading and trailing edges 149*a* and 149*b* are not parallel to reference line 106. In this way, wipers 146*a*, 146*b*, 146*c* and 146*d* do not extend perpendicular to outer wiper ring surface edges 144 and 145, and wipers 146*a*, 146*b*, 146*c* and 146*d* are angled wipers.

In this embodiment, the angle between leading and trailing edges 149*a* and 149*b* and reference line 106 is denoted as $\theta_1$. In some embodiments, angle $\theta_1$ has an angular value between about ten degrees (10°) and eighty degrees (80°). In some embodiments, angle $\theta_1$ has an angular value between about thirty degrees (30°) and sixty degrees (60°). In general, more and less debris is moved by wipers 146*a*, 146*b*, 146*c* and 146*d* towards nose shank 135*a* in response to increasing and decreasing angle $\theta_1$, respectively.

Figure 7F:
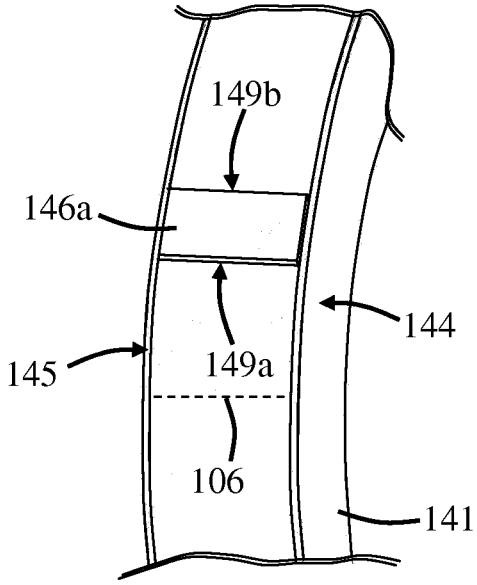
FIG. 7*f* is a close-up perspective view of another embodiment of a nose wiper ring.

An example in which a wiper extends between outer wiper ring surface edges 144 and 145 so that its length is parallel to reference line 106 is shown in FIG. 7*f*. In this example, leading and trailing edges 149*a* and 149*b* are parallel to reference line 106.

In this embodiment, journal assembly 130 includes a gage wiper ring 150 positioned proximate to gage shank 135*b* and away from nose shank 135*a* (FIGS. 6*a*, 6*b* and 6*c*). In particular, gage wiper ring 150 is positioned between gage roller bearing surface 132 and gage shank 135*b*. In this embodiment, gage wiper ring 150 is integrated with journal body 131 so they are a single piece of material. In other embodiments, gage wiper ring 150 is coupled to journal body 131 so it is repeatably removeable therefrom. Gage wiper ring 150 can be coupled to journal body 131 so it is repeatably removeable therefrom in many different ways, such as by using one or more fasteners which fasten it to journal body 131.

In this embodiment, gage wiper ring 150 moves debris away from cutter bearing cavity 103. In particular, gage wiper ring 150 moves debris away from cutter bearing cavity 103 in response to the rotation of cutter 120. In this embodiment, gage wiper ring 150 moves debris through gage interface opening 129*b* and towards gage shank 135*b*. In particular, gage wiper ring 150 moves debris through gage interface opening 129*b* and towards gage shank 135*b* in response to the rotation of cutter 120. In this embodiment, gage wiper ring 150 moves debris away from gage roller bearing surface 132. In particular, gage wiper ring 150 moves debris away from gage roller bearing surface 132 in response to the rotation of cutter 120. In this embodiment, gage wiper ring 150 moves debris towards gage shank 135*b*. In particular, gage wiper ring 150 moves debris towards gage shank 135*b* in response to the rotation of cutter 120. Gage wiper ring 150 can move debris away from cutter bearing cavity 103, gage roller bearing surface 132 and towards gage shank 135*b* in many different ways, one of which will be discussed in more detail presently.

Figure 8F:
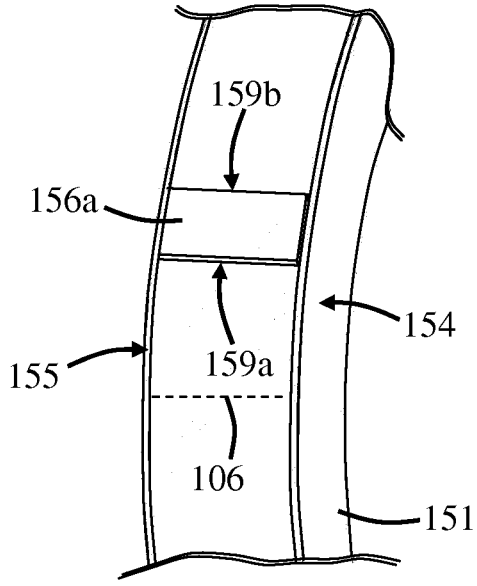
FIG. 8*f* is a close-up perspective view of another embodiment of a gage wiper ring.
Figure 8A:
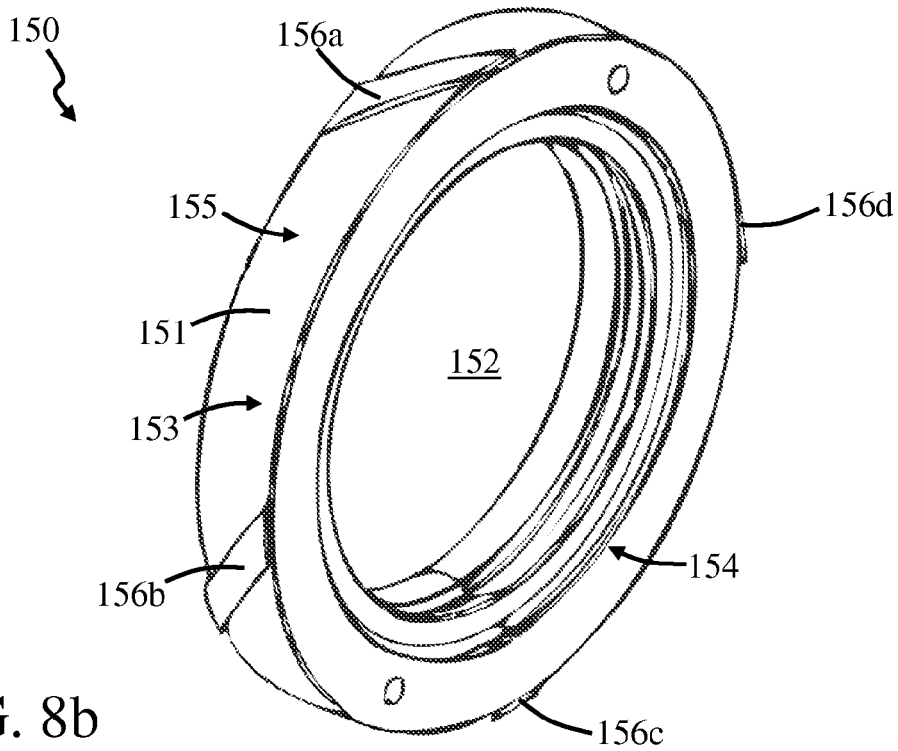
FIGS. 8*a* and 8*b* are opposed perspective views of a gage wiper ring of the journal assembly of FIGS. 6*a* and 6*b*.
Figure 8B:
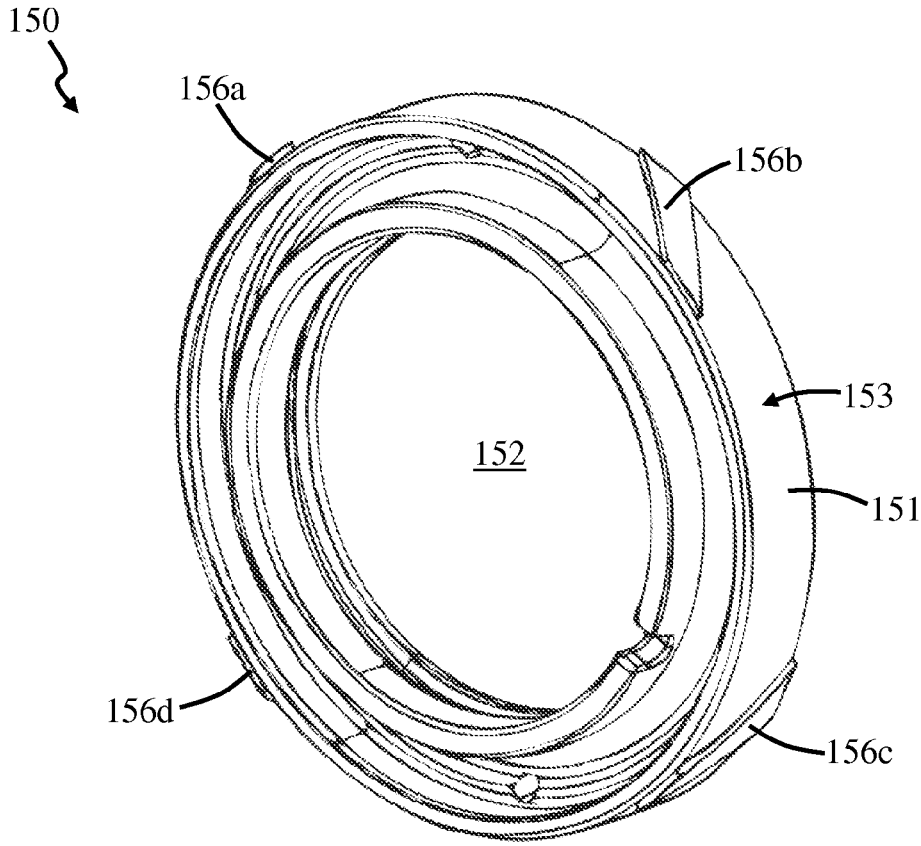
Figure 8C:
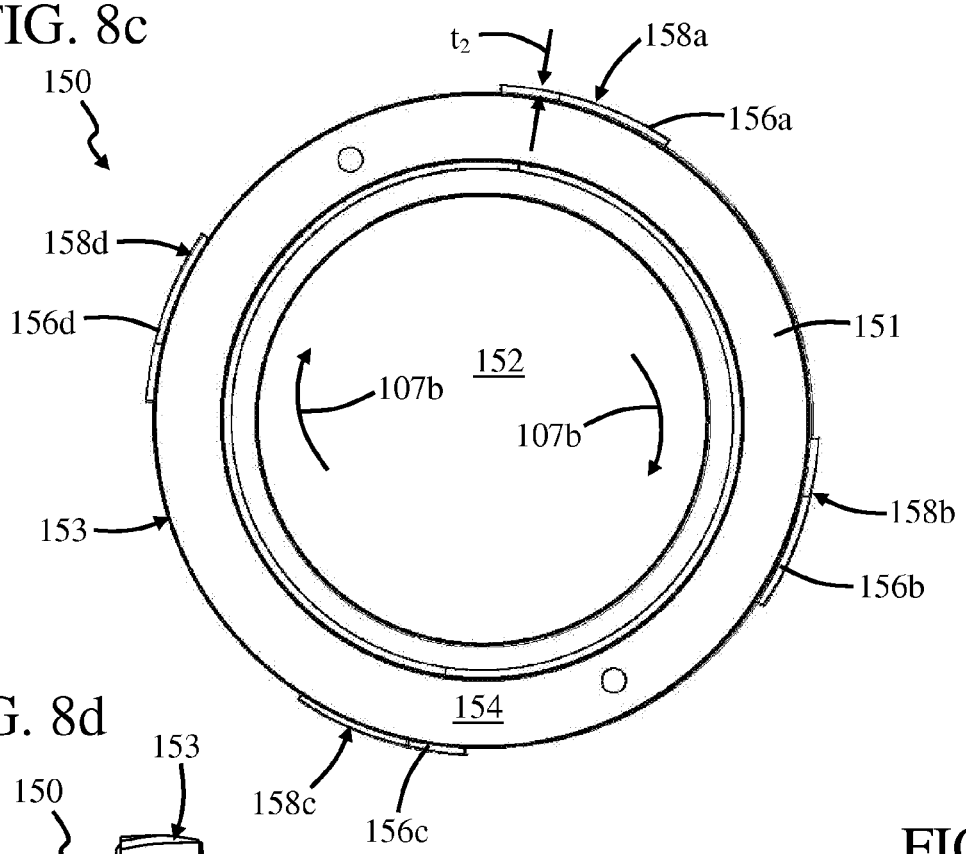
FIGS. 8*c* and 8*d* are front and side views, respectively, of the gage wiper ring of FIGS. 8*a* and 8*b*.
Figure 8D:
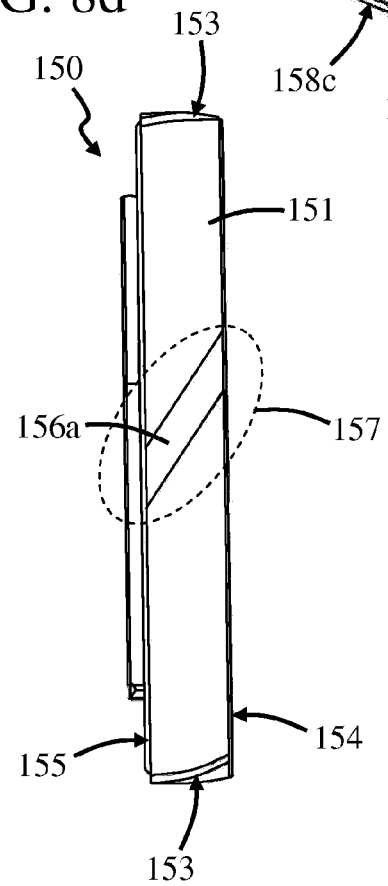
Figure 8E:
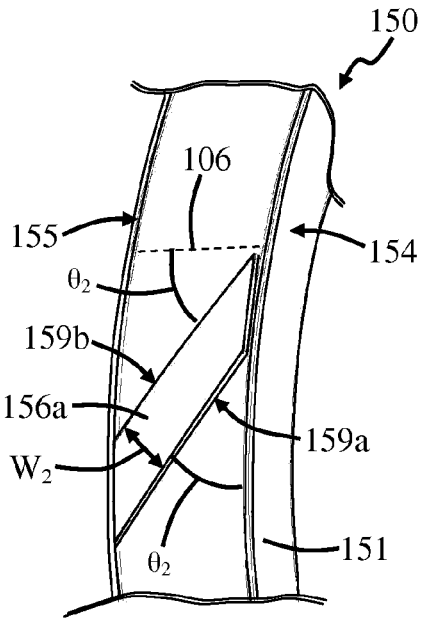
FIG. 8*e* is a close-up perspective view of the gage wiper ring of FIGS. 8*a* and 8*b*.

FIGS. 8*a* and 8*b* are opposed perspective views of gage wiper ring 150. FIGS. 8*c* and 8*d* are front and side views, respectively, of gage wiper ring 150, and FIG. 8*e* is a close-up perspective view of gage wiper ring 150.

In this embodiment, gage wiper ring 150 includes an annularly shaped wiper ring body 151, which has a wiper ring body opening 152 extending therethrough. Wiper ring body opening 152 extends between opposed outer wiper ring surface edges 154 and 155, which are shown in FIG. 8*d*. It should be noted that, as shown in FIG. 6*c*, outer wiper ring surface edge 154 faces gage shank 135*b*, and outer wiper ring surface edge 155 faces away from gage shank 135*b*. Wiper ring body 151 includes an outer wiper ring surface 153, which extends annularly around the outer periphery thereof and faces away from wiper ring body opening 152. Outer wiper ring surface 153 extends between opposed outer wiper ring surface edges 154 and 155.

In this embodiment, wiper ring 150 includes four wipers, which are denoted as wipers 156*a*, 156*b*, 156*c* and 156*d* and are carried by gage wiper ring body 151. It should be noted that wiper ring 150 generally includes one or more wipers carried by gage wiper ring body 151. In this embodiment, four wipers are shown for illustrative purposes.

In this embodiment, wipers 156*a*, 156*b*, 156*c* and 156*d* move debris away from cutter bearing cavity 103. In particular, wipers 156*a*, 156*b*, 156*c* and 156*d* move debris away from cutter bearing cavity 103 in response to the rotation of cutter 120. In this embodiment, wipers 156*a*, 156*b*, 156*c* and 156*d* move debris through gage interface opening 129*b* and towards gage shank 135*b*. In particular, wipers 156*a*, 156*b*, 156*c* and 156*d* move debris through gage interface opening 129*b* and towards gage shank 135*b* in response to the rotation of cutter 120. In this embodiment, wipers 156*a*, 156*b*, 156*c* and 156*d* move debris away from gage roller bearing surface 132. In particular, wipers 156*a*, 156*b*, 156*c* and 156*d* move debris away from gage roller bearing surface 132 in response to the rotation of cutter 120. In this embodiment, wipers 156*a*, 156*b*, 156*c* and 156*d* move debris towards gage shank 135*b*. In particular, wipers 156*a*, 156*b*, 156*c* and 156*d* move debris towards gage shank 135*b* in response to the rotation of cutter 120. In this way, gage wiper ring 150 moves debris away from cutter bearing cavity 103, gage roller bearing surface 132 and towards gage shank 135*b*. It should be noted that the direction of rotation of cutter 120 is in a clockwise direction 107*b*, which is indicated in FIG. 8*c*.

As mentioned above, wipers 156*a*, 156*b*, 156*c* and 156*d* are carried by wiper ring body 151. Wipers 156*a*, 156*b*, 156*c* and 156*d* can be carried by wiper ring body 151 in many different ways so they move debris away from gage roller bearing surface 132 and towards gage shank 135*b* in response to the rotation of wiper ring body 151. In this embodiment, wipers 156*a*, 156*b*, 156*c* and 156*d* are positioned proximate to outer wiper ring surface 153. In particular, wipers 156*a*, 156*b*, 156*c* and 156*d* are engaged with outer wiper ring surface 153 and extend between opposed outer wiper ring surface edges 154 and 155.

In this embodiment, wipers 156*a*, 156*b*, 156*c* and 156*d* include wiper surfaces 158*a*, 158*b*, 158*c* and 158*d*, respectively, as shown in FIG. 8*c*. Wiper surfaces 158*a*, 158*b*, 158*c* and 158*d* face away from wiper ring body opening 152 and outer wiper ring surface 153. It should be noted that wiper surfaces 158*a*, 158*b*, 158*c* and 158*d* curve in response to the curvature of outer wiper ring surface 153. Wiper surfaces 158*a*, 158*b*, 158*c* and 158*d* are spaced from outer wiper ring surface 153. In this embodiment, wiper surfaces 158*a*, 158*b*, 158*c* and 158*d* are each spaced from outer wiper ring surface 153 by a distance $t_2$, as shown in FIG. 8*c*. Further, wiper surfaces 158*a*, 158*b*, 158*c* and 158*d* each have a width of $W_2$, which is a distance between the leading and trailing surfaces of the corresponding wipers 156*a*, 156*b*, 156*c* and 156*d*. For example, width $W_2$ extends between leading and trailing surfaces 159*a* and 159*b* of wiper 156*a*, as shown in FIG. 8*e*. Edges 159*a* and 159*b* are leading and trailing edges, respectively, because cutter 120 rotates about journal assembly 130 from edge 159*a* to edge 159*b*. In some embodiments, width $W_2$ is between about five times to about ten times the value of thickness $t_2$.

It should be noted that wipers 156*a*, 156*b*, 156*c* and 156*d* extend between outer wiper ring surface edges 154 and 155 so that their lengths are not parallel to reference line 106. Reference line 106 extends perpendicular to outer wiper ring surface edges 154 and 155. The lengths of wipers 156*a*, 156*b*, 156*c* and 156*d* are not parallel to reference line 106 because leading and trailing edges 159*a* and 159*b* are not parallel to reference line 106. In this way, wipers 156*a*, 156*b*, 156*c* and 156*d* do not extend perpendicular to outer wiper ring surface edges 154 and 155, and wipers 156*a*, 156*b*, 156*c* and 156*d* are angled wipers.

In this embodiment, the angle between leading and trailing edges 159*a* and 159*b* and reference line 106 is denoted as $\theta_2$. In some embodiments, angle $\theta_2$ has an angular value between about ten degrees (10°) and eighty degrees (80°). In some embodiments, angle $\theta_2$ has an angular value between about thirty degrees (30°) and sixty degrees (60°). In general, more and less debris is moved by wipers 156*a*, 156*b*, 156*c* and 156*d* towards gage shank 135*b* in response to increasing and decreasing angle $\theta_2$, respectively.

An example in which a wiper extends between outer wiper ring surface edges 154 and 155 so that its length is parallel to reference line 106 is shown in FIG. 8*f*. In this example, leading and trailing edges 159*a* and 159*b* are parallel to reference line 106.

Figure 9A:
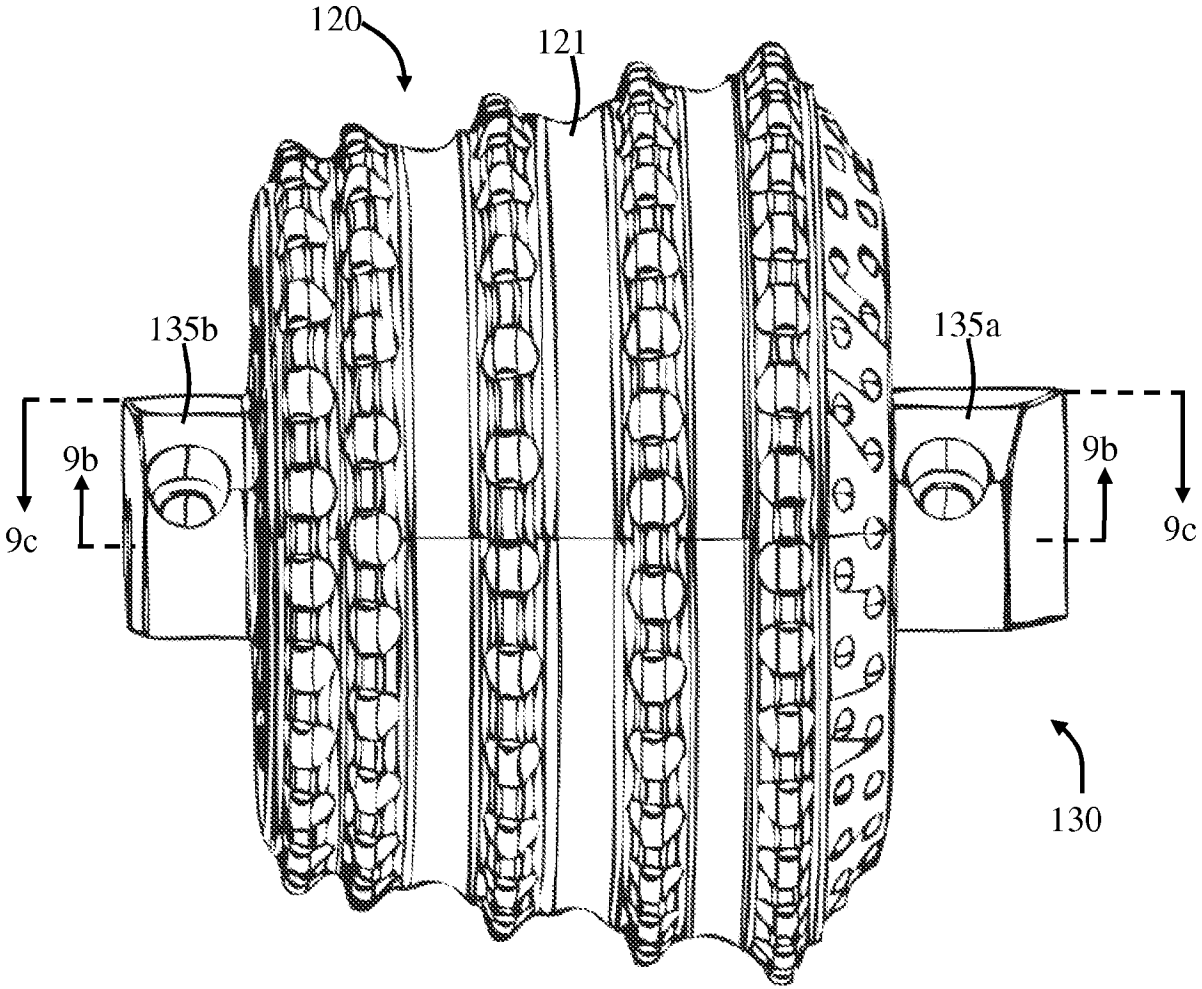
FIG. 9*a* is a side view of the cutter of FIGS. 1*a* and 1*b* rotatably mounted to the journal assembly.
Figure 9B:
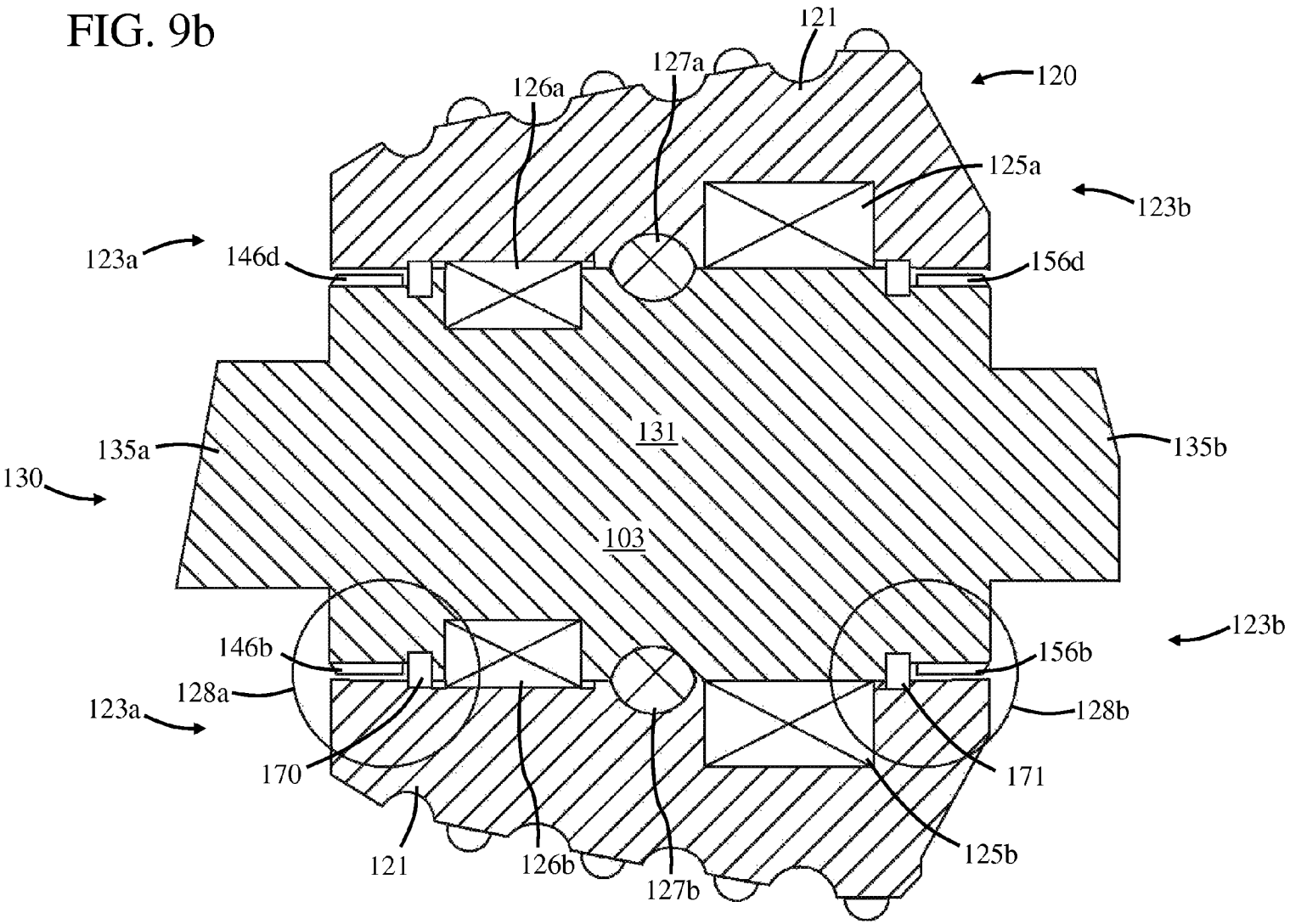
FIG. 9*b* is a cut-away side view, taken along a cut-line 9*b*-9*b* of FIG. 9*a*, of the cutter of FIG. 9*a* rotatably mounted to the journal assembly.
Figure 9C:
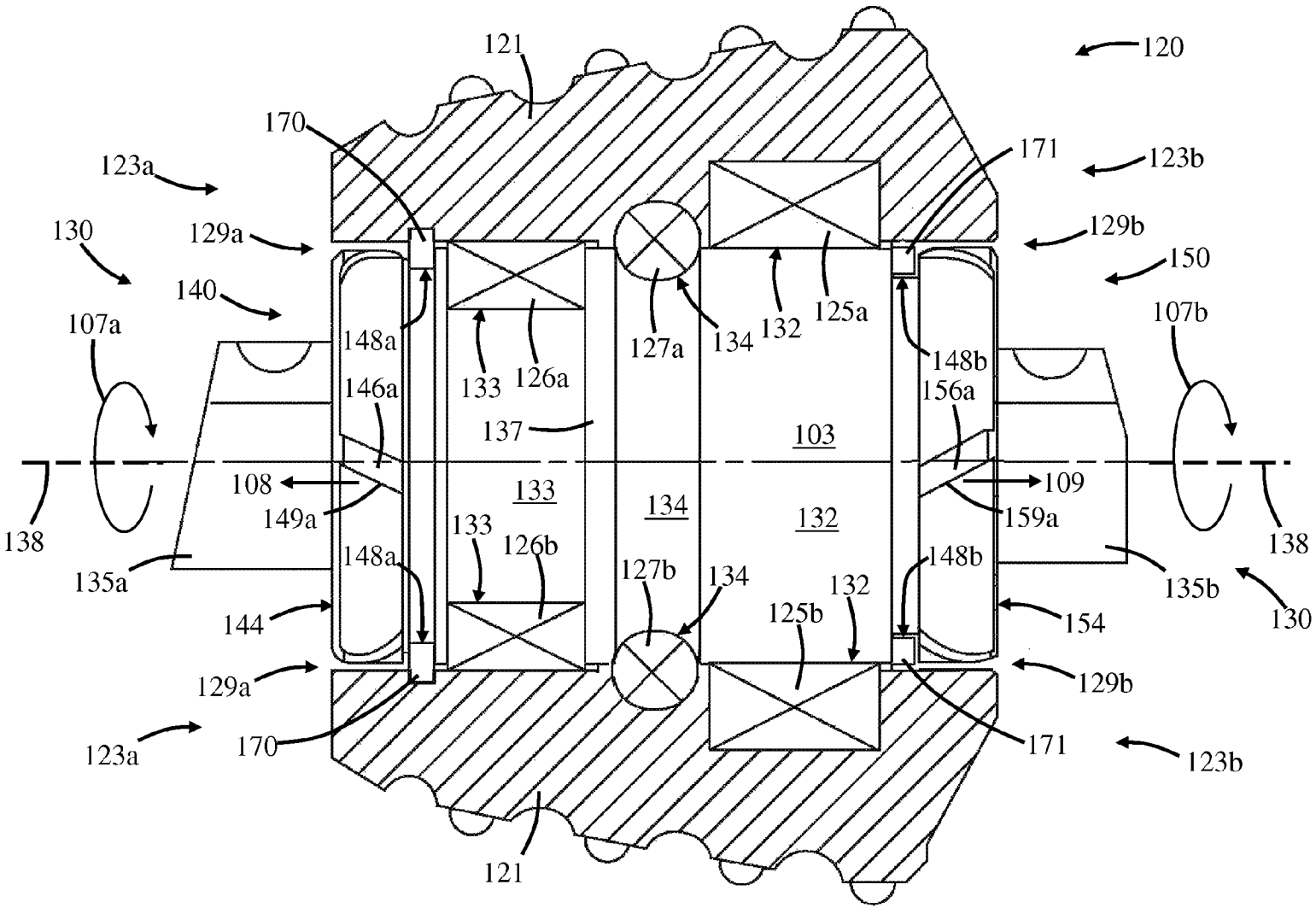
FIG. 9*c* is a cut-away side view, taken along a cut-line 9*c*-9*c* of FIG. 9*a*, of the cutter of FIG. 9*a* rotatably mounted to the journal assembly.

FIG. 9*a* is a side view of cutter 120 rotatably mounted to journal assembly 130. FIG. 9*b* is a cut-away side view of cutter 120 rotatably mounted to journal assembly 130 taken along a cut-line 9*b*-9*b* of FIG. 9*a*. FIG. 9*c* is a cut-away side view of cutter 120 rotatably mounted to journal assembly 130 taken along a cut-line 9*c*-9*c* of FIG. 9*a*.

In this embodiment, a plurality of roller bearings, some of which are denoted as roller bearings 125*a*, 125*b*, 126*a* and 126*b*, extend through cutter bearing cavity 103. Roller bearings 125*a* and 125*b* engage cutter 120 and gage roller bearing surface 132 of journal body 131, and roller bearings 126*a* and 126*b* engage cutter 120 and nose roller bearing surface 133 of journal body 131. A plurality of ball bearings, some of which are denoted as ball bearings 127*a* and 127*b*, extend through cutter bearing cavity 103. Ball bearings 127*a* and 127*b* engage cutter 120 and ball bearing groove 134 of journal body 131. The roller and ball bearings facilitate the ability of cutter 120 to rotate about journal assembly 130.

In this embodiment, nose and gage seal assembly surfaces 148*a* and 148*b* are engaged by nose and gage seal assemblies 170 and 171. Nose and gage seal assemblies establish a seal between journal body 131 and cutter 120. Nose seal assembly 170 is positioned between nose wiper ring 140 and roller bearings 126*a* and 126*b*, and gage seal assembly 171 is positioned between gage wiper ring 150 and roller bearings 125*a* and 125*b*.

In this embodiment, nose seal assembly 170 is annular in shape and includes a central opening for receiving journal body 131. Nose seal assembly 170 can include many different components. In some embodiments, nose seal assembly 170 includes an O-ring seal and/or metal face seal.

In this embodiment, gage seal assembly 171 is annular in shape and includes a central opening for receiving journal body 131. Gage seal assembly 171 can include many different components. In some embodiments, nose seal assembly 170 includes an O-ring seal and/or metal face seal.

In operation, raise boring reamer assembly 100 (FIGS. 1*a* and 1*b*) is operatively coupled to a drill string (not shown), and moved upwardly through the formation and rotated to form the borehole. As raise boring reamer assembly 100 moves upwardly and rotates, cutter 120 engages the formation and rotates in a rotation direction 107 (FIG. 9*c*) about journal assembly 130 in response. Debris flows towards cutter bearing cavity 103 in response to raise boring reamer assembly 100 being moved upwardly through the formation. In particular, debris flows towards cutter bearing cavity 103 through nose and gage interface openings 129*a* and 129*b* in response to raise boring reamer assembly 100 being moved upwardly through the formation. As mentioned above, debris in cutter bearing cavity 103 restricts the ability of cutter 120 to rotate about journal assembly 130. Hence, it is desirable to restrict the ability of debris to flow to cutter bearing cavity 103, and to move debris away from cutter bearing cavity 103.

In this embodiment, nose seal assembly 170 restricts the ability of debris to flow to cutter bearing cavity through nose interface opening 129*a*. Nose seal assembly 170 restricts the ability of debris to flow to cutter bearing cavity through nose interface opening 129*a* because it establishes a seal between journal body 131 and cutter 120. In particular, nose seal assembly 170 establishes a seal between nose seal assembly surface 148*a* and cutter 120.

Figure 9D:
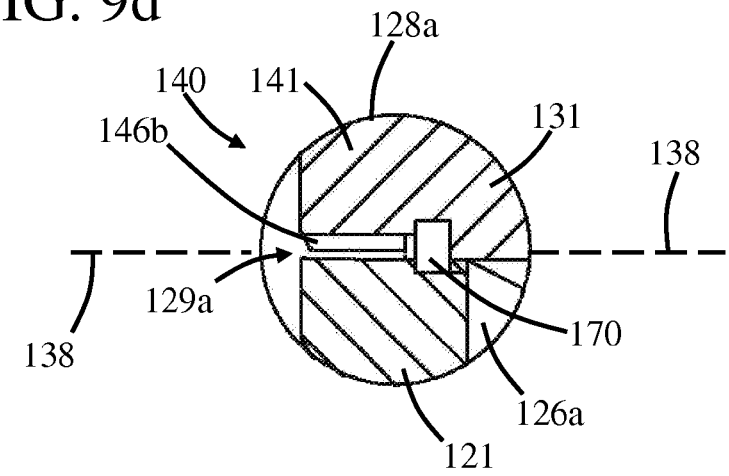
FIG. 9*d* is a close-up view of the nose wiper ring in a nose seal region of FIG. 9*b*.

FIG. 9*d* is a close-up view of a nose seal region 128*a* of FIG. 9*b*. In this embodiment, the wipers of nose wiper ring 140 move debris away from cutter bearing cavity 103. In particular, the wipers of nose wiper ring 140 move debris away from cutter bearing cavity 103 through nose interface opening 129*a*. The wipers of nose wiper ring 140 move debris away from cutter bearing cavity 103 through nose interface opening 129*a* towards nose shank 135*a*. As mentioned above, the wipers of nose wiper ring 140 move debris in response to the rotation of cutter 120. The wipers of nose wiper ring 140 move debris in direction 108, as shown in FIG. 9*c*, in response to the rotation of cutter 120. It should be noted that direction 108 is substantially parallel to longitudinal journal axis 138. In this embodiment, the wipers of nose wiper ring 140 include wipers 146*a*, 146*b*, 146*c* and 146*d*, wherein nose wiper ring 146*b* is shown in FIG. 9*d*.

In this embodiment, nose seal assembly 170 restricts the ability of debris to flow to cutter bearing cavity through nose interface opening 129*a*. Nose seal assembly 170 restricts the ability of debris to flow to cutter bearing cavity through nose interface opening 129*a* because it establishes a seal between journal body 131 and cutter 120. In particular, nose seal assembly 170 establishes a seal between nose seal assembly surface 148*a* and cutter 120.

Figure 9E:
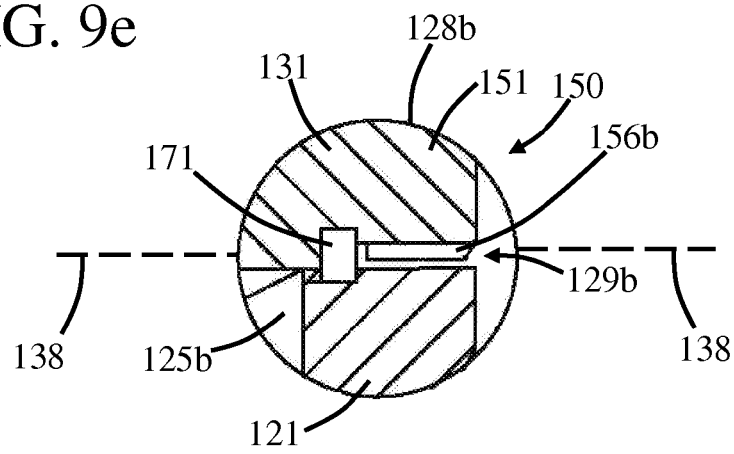
FIG. 9*e* is a close-up view of the gage wiper ring in a gage seal region of FIG. 9*b*.

FIG. 9*e* is a close-up view of a gage seal region 128*b* of FIG. 9*b*. In this embodiment, the wipers of gage wiper ring 150 move debris away from cutter bearing cavity 103. In particular, the wipers of gage wiper ring 150 move debris away from cutter bearing cavity 103 through gage interface opening 129*b*. The wipers of gage wiper ring 140 move debris away from cutter bearing cavity 103 through gage interface opening 129*b* towards gage shank 135*b*. As mentioned above, the wipers of gage wiper ring 150 move debris in response to the rotation of cutter 120. The wipers of gage wiper ring 150 move debris in direction 109, as shown in FIG. 9*c*, in response to the rotation of cutter 120. It should be noted that direction 109 is substantially parallel to longitudinal journal axis 138. In this embodiment, the wipers of gage wiper ring 150 include wipers 156*a*, 156*b*, 156*c* and 156*d*, wherein gage wiper ring 156*b* is shown in FIG. 9*e*.

In this embodiment, gage seal assembly 171 restricts the ability of debris to flow to cutter bearing cavity through gage interface opening 129*b*. Gage seal assembly 171 restricts the ability of debris to flow to cutter bearing cavity through gage interface opening 129*b* because it establishes a seal between journal body 131 and cutter 120. In particular, gage seal assembly 171 establishes a seal between gage seal assembly surface 148*b* and cutter 120.

Figure 9F:
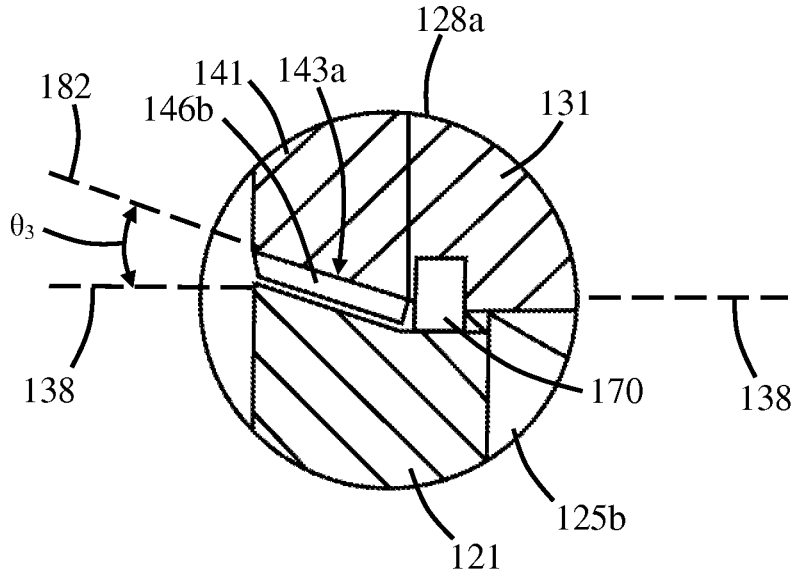
FIG. 9*f* is another embodiment of nose wiper ring in a nose seal region of FIG. 9*b*.

FIG. 9*f* is another embodiment of nose wiper ring 140 in nose seal region 128*a*. In this embodiment, nose wiper ring 140 includes an inwardly tapered outer wiper ring surface, which is denoted as inwardly tapered outer wiper ring surface 143*a*. Surface 143*a* is tapered because it does not extend parallel to longitudinal journal axis 138. In this particular embodiment, inwardly tapered outer wiper ring surface 143*a* extends along a reference line 182, which is at an angle $\theta_3$ relative to longitudinal journal axis 138. Surface 143*a* is tapered inwardly because it extends towards shank 135*a* as it extends away from nose seal assembly 170 (FIG. 9*b*). It should be noted that outer wiper ring surface 143, as shown in FIGS. 7*a*, 7*b*, 7*c* and 7*d*, is a non-tapered surface because it does extend parallel to longitudinal journal axis 138.

Figure 9G:
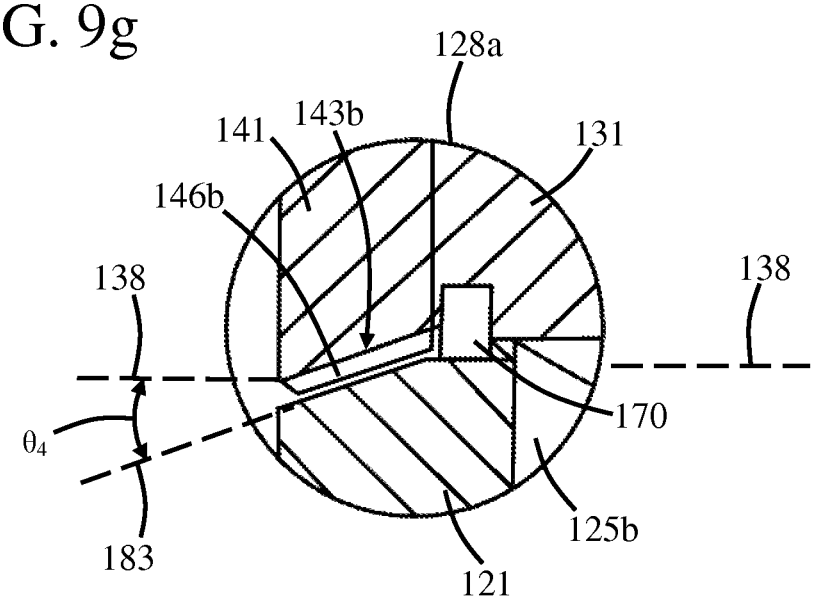
FIG. 9*g* is another embodiment of nose wiper ring in the nose seal region of FIG. 9*b*.

FIG. 9*g* is another embodiment of nose wiper ring 140 in nose seal region 128*a*. In this embodiment, nose wiper ring 140 includes an outwardly tapered outer wiper ring surface, which is denoted as outwardly tapered outer wiper ring surface 143*b*. Surface 143*b* is tapered because it does not extend parallel to longitudinal journal axis 138. In this particular embodiment, outwardly tapered outer wiper ring surface 143*b* extends along a reference line 183, which is at an angle $\theta_4$ relative to longitudinal journal axis 138. Surface 143*b* is tapered outwardly because it extends away from nose shank 135*a* as it extends away from nose seal assembly 170 (FIG. 9*b*).

Figure 9H:
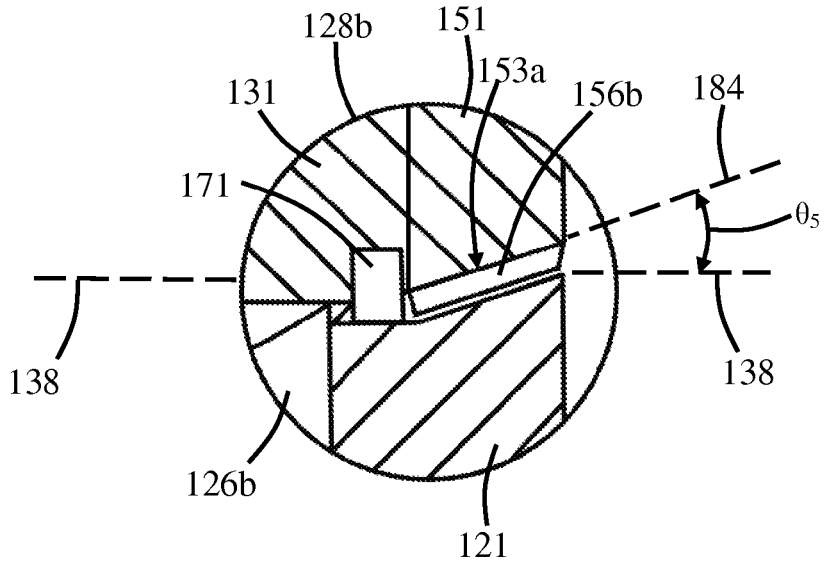
FIG. 9*h* is another embodiment of gage wiper ring in the gage seal region of FIG. 9*b*.

FIG. 9*h* is another embodiment of gage wiper ring 150 in gage seal region 128*b*. In this embodiment, gage wiper ring 150 includes an inwardly tapered outer wiper ring surface, which is denoted as inwardly tapered outer wiper ring surface 153*a*. Surface 153*a* is tapered because it does not extend parallel to longitudinal journal axis 138. In this particular embodiment, inwardly tapered outer wiper ring surface 153*a* extends along a reference line 184, which is at an angle $\theta_5$ relative to longitudinal journal axis 138. Surface 153*a* is tapered inwardly because it extends towards gage shank 135*b* as it extends away from gage seal assembly 171 (FIG. 9*b*). It should be noted that outer wiper ring surface 153, as shown in FIGS. 8*a*, 8*b*, 8*c* and 8*d*, is a non-tapered surface because it does extend parallel to longitudinal journal axis 138.

Figure 9I:
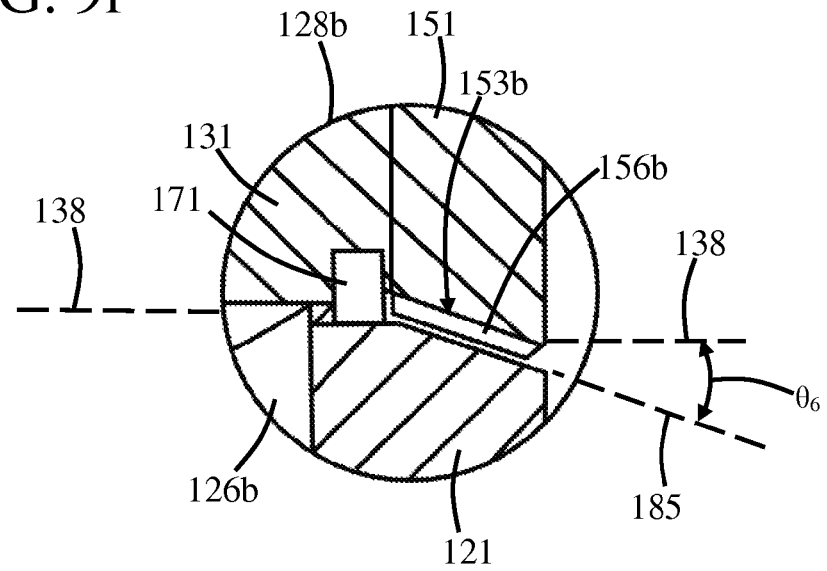
FIG. 9*i* is another embodiment of gage wiper ring in the gage seal region of FIG. 9*b*.

FIG. 9*i* is another embodiment of gage wiper ring 150 in gage seal region 128*b*. In this embodiment, gage wiper ring 150 includes an outwardly tapered outer wiper ring surface, which is denoted as outwardly tapered outer wiper ring surface 153*b*. Surface 153*b* is tapered because it does not extend parallel to longitudinal journal axis 138. In this particular embodiment, outwardly tapered outer wiper ring surface 153*b* extends along a reference line 185, which is at an angle $\theta_6$ relative to longitudinal journal axis 138. Surface 153*b* is tapered outwardly because it extends away from gage shank 135*b* as it extends away from gage seal assembly 171 (FIG. 9*b*).

The embodiments of the invention described herein are exemplary and numerous modifications, variations and rearrangements can be readily envisioned to achieve substantially equivalent results, all of which are intended to be embraced within the spirit and scope of the invention as defined in the appended claims.

The invention claimed is:

1. A raise boring cutter, comprising:

a journal assembly having nose and gage shanks;

a cutter carried by the journal assembly;

a nose wiper ring carried by the journal assembly, the nose wiper ring being positioned proximate to the nose shank, wherein the nose wiper ring moves debris towards the nose shank in response to the rotation of the cutter, wherein the nose wiper ring includes a plurality of nose wipers on an outer nose wiper ring surface which extend at a non-zero angle relative to an axis of rotation of the cutter; and a gage wiper ring carried by the journal assembly, the gage wiper ring being positioned proximate to the gage shank, wherein the gage wiper ring moves debris towards the gage shank in an axial direction in response to the rotation of the cutter, wherein the gage wiper ring includes a plurality of gage wipers on an outer nose wiper ring which extend at a non-zero angle relative to an axis of rotation of the cutter.

2. A raise boring cutter, comprising:

a saddle;

a journal assembly carried by the saddle, wherein the journal assembly includes a nose shank;

a cutter carried by the journal assembly to form a cutter bearing cavity therebetween;

a nose seal assembly;

a nose wiper ring positioned proximate to the nose shank, wherein the nose wiper ring includes a nose wiper carried by the nose wiper ring on an outer wiper ring surface which extends at a non-perpendicular angle between opposed outer wiper ring surface edges of the nose wiper ring; and wherein the nose wiper ring moves debris away from the cutter bearing cavity in response to the rotation of the cutter.

3. The raise boring cutter of claim 2, wherein the nose wiper ring moves debris towards the nose shank in response to the rotation of the cutter.

4. The raise boring cutter of claim 2, wherein the journal assembly includes a gage shank.

5. The raise boring cutter of claim 4, further including a gage wiper ring positioned proximate to the gage shank, wherein the gage wiper ring move debris away from the cutter bearing cavity in response to the rotation of the cutter.

6. The raise boring cutter of claim 5, wherein the gage wiper ring moves debris towards the gage shank in response to the rotation of the cutter.

7. The raise boring cutter of claim 5, wherein the gage wiper ring has a larger outer dimension than the nose wiper ring.

8. A raise boring cutter, comprising:

a saddle;

a journal assembly carried by the saddle, wherein the journal assembly includes nose and gage shanks;

a cutter carried by the journal assembly;

nose and gage seal assemblies; and nose and gage wiper rings positioned proximate to the nose and gage shanks, respectively, wherein the nose wiper ring includes a nose wiper which extends at a non-perpendicular angle between opposed outer wiper ring surface edges of the nose wiper ring and the gage wiper ring includes a gage wiper which extends at a non-perpendicular angle between opposed outer wiper ring surface edges of the gage wiper ring;

wherein the nose and gage wiper rings move debris in opposed directions in response to the rotation of the cutter.

9. The raise boring cutter of claim 8, wherein the nose and gage wiper rings moves debris towards the nose and gage shanks, respectively, in response to the rotation of the cutter.

10. The raise boring cutter of claim 8, wherein the nose and gage wiper rings each include wiper ring body openings through which the journal extends.

11. The raise boring cutter of claim 8, wherein the saddle includes a cutter recess through which the cutter extends.

12. The raise boring cutter of claim 8, wherein the saddle includes nose and gage shank couplers coupled to the nose and gage shanks, respectively.

* * * * *